US012065805B2

(12) United States Patent
Saitoh et al.

(10) Patent No.: US 12,065,805 B2
(45) Date of Patent: Aug. 20, 2024

(54) WORK MACHINE

(71) Applicant: Hitachi Construction Machinery Co., Ltd., Tokyo (JP)

(72) Inventors: Teppei Saitoh, Tokyo (JP); Kouji Fujita, Tsuchiura (JP); Hideaki Itou, Tsuchiura (JP); Hidefumi Ishimoto, Tsuchiura (JP); Ryu Narikawa, Tokyo (JP); Tadashi Nishizawa, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 18/026,146

(22) PCT Filed: Feb. 3, 2022

(86) PCT No.: PCT/JP2022/004180
§ 371 (c)(1),
(2) Date: Mar. 14, 2023

(87) PCT Pub. No.: WO2022/190725
PCT Pub. Date: Sep. 15, 2022

(65) Prior Publication Data

US 2023/0366178 A1 Nov. 16, 2023

(30) Foreign Application Priority Data

Mar. 9, 2021 (JP) ..... 2021-037799

(51) Int. Cl.
*E02F 9/20* (2006.01)
*E02F 9/08* (2006.01)
(Continued)

(52) U.S. Cl.
CPC ..... *E02F 9/205* (2013.01); *E02F 9/0833* (2013.01); *E02F 9/16* (2013.01); *E02F 9/226* (2013.01); *E02F 9/2267* (2013.01)

(58) Field of Classification Search
CPC . E02F 9/0833; E02F 9/16; E02F 9/205; E02F 9/226; E02F 9/24
See application file for complete search history.

(56) References Cited

U.S. PATENT DOCUMENTS 10,711,437 B2 * 7/2020 Nishiguchi ..... E02F 9/16
10,988,914 B2 * 4/2021 Yoshida ..... E02F 9/2075
(Continued)

FOREIGN PATENT DOCUMENTS

JP 2009-114631 A 5/2009
JP 2016-69963 A 5/2016
(Continued)

OTHER PUBLICATIONS

International Preliminary Report on Patentability (PCT/IB/338 & PCT/IB/373) issued in PCT Application No. PCT/JP2022/004180 dated Sep. 21, 2023, Including English translation of document C2 (Japanese-language Written Opinion (PCT/ISA/237), filed on Mar. 14, 2023) (5 pages).
(Continued)

*Primary Examiner* — Michael Leslie
(74) *Attorney, Agent, or Firm* — Crowell & Moring LLP

(57) ABSTRACT

A work machine includes a second pilot line that introduces a hydraulic fluid from a pilot hydraulic fluid source to a pilot valve bypassing a first gate lock valve, a second gate lock valve that is disposed on the second pilot line and that is configured to be switched to an open position for allowing the supply of the hydraulic fluid to the pilot valve or a closed position for interrupting the supply of the hydraulic fluid, and a controller that controls the second gate lock valve on the basis of a second remote operation signal transmitted from a remote operation apparatus and that controls the pilot valve according to a first remote operation signal transmitted from the remote operation apparatus. In a state where the first gate lock valve is at a closed position, the second gate
(Continued)

lock valve is allowed to be controlled by the controller when stairs are in a retracted state, and is kept at the closed position irrespective of the second remote operation signal when the stairs are in an extended state.

4 Claims, 10 Drawing Sheets

(51) Int. Cl.
*E02F 9/16* (2006.01)
*E02F 9/22* (2006.01)

(56) References Cited

U.S. PATENT DOCUMENTS

| | | | |
|---|---|---|---|
| 2017/0058489 | A1 | 3/2017 | Nomura et al. |
| 2018/0080198 | A1 | 3/2018 | Machida et al. |
| 2021/0164192 | A1 | 6/2021 | Konda et al. |

FOREIGN PATENT DOCUMENTS

| | | | | |
|---|---|---|---|---|
| JP | 2017-186875 | A | 10/2017 | |
| JP | 2020-41352 | A | 3/2020 | |
| JP | 2020-105879 | A | 7/2020 | |
| WO | WO-2015107663 | A1 * | 7/2015 | ..... E02F 3/308 |
| WO | WO 2016/174977 | A1 | 11/2016 | |

OTHER PUBLICATIONS

International Search Report (PCT/ISA/210) issued in PCT Application No. PCT/JP2022/004180 dated Mar. 22, 2022 with English translation (five (5) pages).
Japanese-language Written Opinion (PCT/ISA/237) issued in PCT Application No. PCT/JP2022/004180 dated Mar. 22, 2022 (four (4) pages).

* cited by examiner

WORK MACHINE

TECHNICAL FIELD

The present invention relates to a work machine, and in particular relates to a work machine that can remotely be operated.

BACKGROUND ART

In the field of work machines such as hydraulic excavators or bulldozers, an unmanned, remote operation has been a subject of development in recent years. In order to perform a remote operation of a work machine, first, a worker needs to get into the work machine and activate devices that enable the remote operation. Such devices are, for example, a communication device that receives a remote operation signal from a remote operation apparatus and a controller that performs control according to the remote operation signal.

Meanwhile, a large-sized hydraulic excavator used for mining or the like includes stairs for allowing a worker to get into the hydraulic excavator. Those stairs have an extendable and retractable structure in order to prevent the stairs from interrupting work or coming into contact with the ground during the operation of the hydraulic excavator, for example. Accordingly, the worker needs to extend the stairs being retracted, when getting into and out of the hydraulic excavator.

When a hydraulic excavator including extendable and retractable stairs (hereinafter, retractable stairs) is to be remotely operated, a worker first gets into the hydraulic excavator by using the retractable stairs being extended, and activates a communication device and a controller of the hydraulic excavator. Thereafter, the worker gets out of the hydraulic excavator by using the retractable stairs in the extended state, and retracts the retractable stairs being extended. In this manner, in order to start the remote operation of the large-sized hydraulic excavator, it is necessary for the worker to perform a series of work mentioned above.

As a known technology related to a remote operation of a hydraulic excavator including retractable stairs, a technology described in Patent Document 1 is known. In a work machine described in Patent Document 1, in order to monitor the surroundings according to a raised/lowered state of a climbing ladder (retractable stairs), a display of a monitor in a remote operation room is switched to a camera image including the climbing ladder in an image-capturing area, when the climbing ladder is at its retracted position. On the other hand, the display is switched to a camera image of a space behind the hydraulic excavator when the climbing ladder is at its use position.

PRIOR ART DOCUMENT

Patent Document

Patent Document 1: WO 2016/174977

SUMMARY OF THE INVENTION

Problem to be Solved by the Invention

Regarding the work machine described in Patent Document 1, the monitor in the remote operation room displays an image of a space around the climbing ladder (retractable stairs) when the climbing ladder is at its use position. Accordingly, an operator in the remote operation room can recognize the situation around the climbing ladder. However, the operator may possibly overlook the climbing ladder in the extended state. If the hydraulic excavator is remotely operated in such a situation, the hydraulic excavator performs work and travels undesirably while the climbing ladder is still in the extended state. When the climbing ladder is in the extended state, a worker may be in the hydraulic excavator. The worker in the hydraulic excavator cannot get out of the hydraulic excavator due to a remote operation of the hydraulic excavator, even if the climbing ladder is in the extended state, and cannot perform necessary work. Accordingly, the operating rate of the hydraulic excavator and the productivity of the site deteriorate undesirably.

The present invention has been made on the basis of the matters mentioned above, and an object thereof is to provide a work machine with extendable and retractable stairs that can suppress deterioration in the operating rate and productivity of the work machine which is caused by a remote operation of the work machine.

Means for Solving the Problem

The present application includes a plurality of pieces of means for solving the problem described above. One example thereof is a work machine that includes an operation room into which a worker gets, stairs that are able to be switched to an extended state where the stairs allow the worker to get into and out of the operation room and a retracted state where the stairs are retracted so as not to interrupt work, a hydraulic actuator that is driven by supply of a hydraulic fluid, a hydraulic-pilot type control valve that controls a flow of the hydraulic fluid supplied to the hydraulic actuator, a pilot valve that generates a pilot pressure for driving the control valve, by using a pressure from a pilot hydraulic fluid source as a source pressure, a first pilot line that introduces the hydraulic fluid from the pilot hydraulic fluid source to the pilot valve, a first gate lock valve that is disposed on the first pilot line and that is configured to be switched to either an open position for allowing supply of the hydraulic fluid from the pilot hydraulic fluid source to the pilot valve or a closed position for interrupting the supply of the hydraulic fluid from the pilot hydraulic fluid source to the pilot valve, a first operation device that is arranged in the operation room and that is used to operate the hydraulic actuator, and a first gate lock device that is arranged in the operation room and that is used to operate the first gate lock valve. The work machine is capable of being remotely operated by a remote operation apparatus at a location away from the operation room. The work machine includes a second pilot line that introduces the hydraulic fluid from the pilot hydraulic fluid source to the pilot valve bypassing the first gate lock valve, a second gate lock valve that is disposed on the second pilot line and that is configured to be switched to either an open position for allowing the supply of the hydraulic fluid from the pilot hydraulic fluid source to the pilot valve or a closed position for interrupting the supply of the hydraulic fluid from the pilot hydraulic fluid source to the pilot valve, an operation mode selector that is switched manually by the worker to either an operation position for a remote operation mode or an operation position for an in-machine operation mode, the remote operation mode representing a mode for a remote operation by the remote operation apparatus, the in-machine operation mode representing a mode for an operation by the worker who is in the operation room, a selector valve that is disposed on the second pilot line and that is configured to be switched, by the switching operation of the operation mode selector, to either an open position for allowing the supply of the hydraulic fluid from the pilot hydraulic fluid source to the pilot valve or a closed position for interrupting the supply of the hydraulic fluid from the pilot hydraulic fluid source to the pilot valve, and a controller that controls an opening of the pilot valve according to a first remote operation signal transmitted by the remote operation apparatus and that controls the second gate lock valve such that the second gate lock valve is caused to be at either the open position or the closed position on a basis of a second remote operation signal transmitted by the remote operation apparatus, the remote operation apparatus including a second operation device that outputs the first remote operation signal for remotely operating the hydraulic actuator and a second gate lock device that outputs the second remote operation signal for giving an instruction for enabling or disabling of the remote operation by the second operation device. In a state where the first gate lock valve has been switched to the closed position, the second gate lock valve is allowed to be controlled by the controller when the stairs are in the retracted state, and the second gate lock valve is kept at the closed position irrespective of the second remote operation signal when the stairs are in the extended state.

Advantages of the Invention

According to the present invention, the second gate lock valve is kept at the closed position when the stairs are in the extended state. Thus, the remote operation of the hydraulic actuator by the remote operation apparatus is disabled when the stairs are in the extended state, and the remote operation by the remote operation apparatus is allowed only when the stairs are in the retracted state. This makes it possible to prevent a situation where the work machine starts moving by a remote operation with the stairs extended and where a worker becomes unable to get out of the work machine. Accordingly, it is possible for the work machine including the extendable and retractable stairs to suppress the deterioration in the operating rate and productivity which is caused by the remote operation of the work machine.

Problems, configurations, and advantages other than those described above are made clear by the following explanation of embodiments.

MODES FOR CARRYING OUT THE INVENTION

Now, work machines according to embodiments of the present invention will be explained below by using the figures. In the following embodiments, a large-sized hydraulic excavator will be described as an example of the work machine.

First Embodiment

Figure 1:
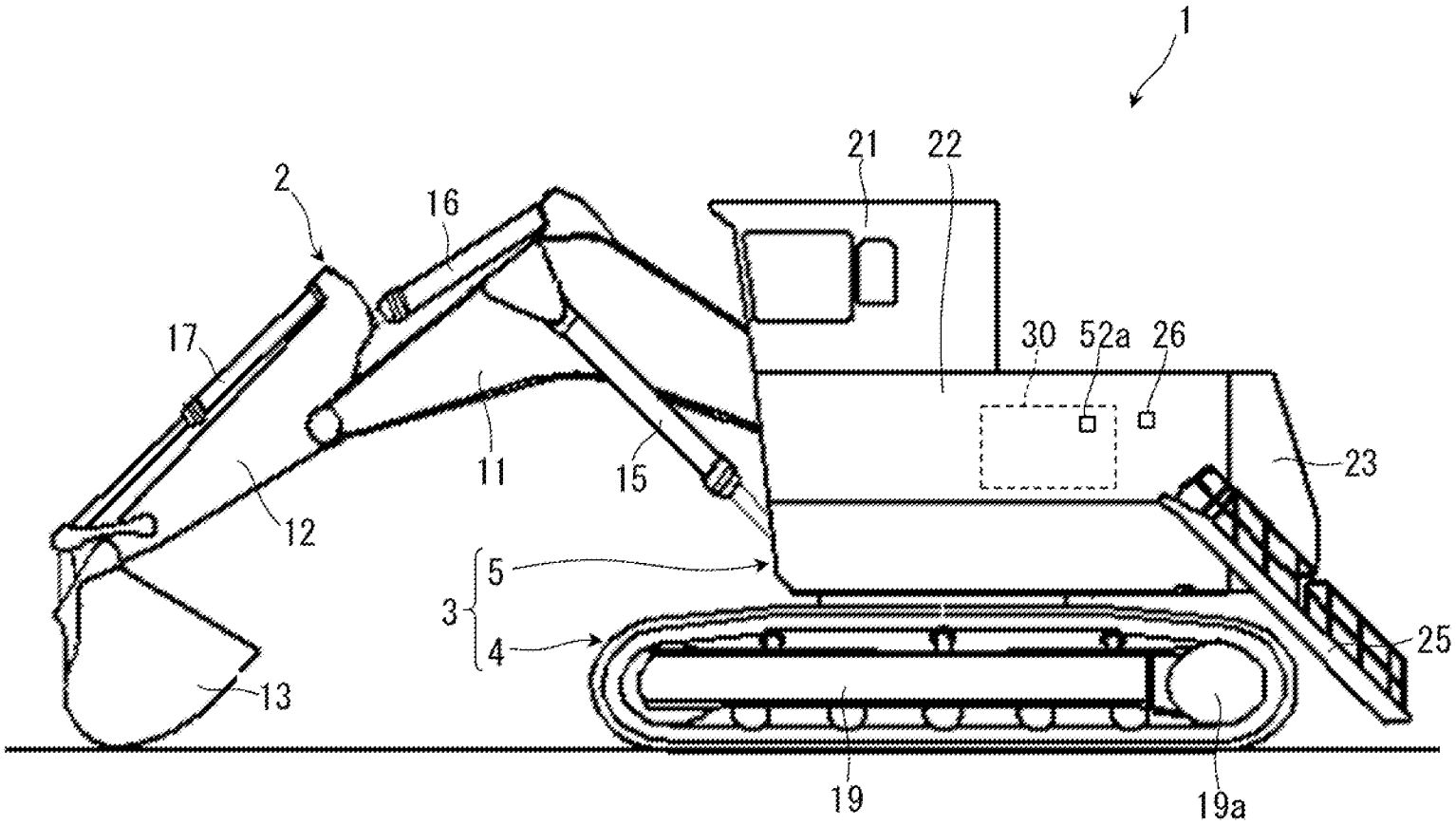
FIG. 1 is a schematic diagram depicting a hydraulic excavator as a work machine according to a first embodiment of the present invention.

First, the schematic configuration of a hydraulic excavator as a work machine according to a first embodiment of the present invention is explained by using FIG. 1. FIG. 1 is a schematic diagram depicting the hydraulic excavator as the work machine according to the first embodiment of the present invention. Here, explanations are given by using directions as seen from a worker sitting on an operator's seat.

In FIG. 1, a hydraulic excavator 1 as the work machine includes a front work implement 2 for performing excavation work and the like, and a body 3 to which the front work implement 2 is attached pivotably. The body 3 includes a lower travel structure 4 that is capable of travelling, and an upper swing structure 5 mounted swingably on the lower travel structure 4. The hydraulic excavator 1 is able to be remotely operated by a remote operation apparatus 100 mentioned later (see FIG. 2 mentioned later) which is at a location away from the hydraulic excavator 1.

The front work implement 2 is an articulated-type work implement including a plurality of driven members for performing excavation work and the like. The plurality of driven members are coupled to one another pivotably in the vertical direction. For example, the plurality of driven members include a boom 11, an arm 12, and a bucket 13 as a work tool. A base end portion of the boom 11 is pivotably supported on a front portion of the upper swing structure 5. A base end portion of the arm 12 is pivotably supported on a tip portion of the boom 11. The bucket 13 is pivotably supported on a tip portion of the arm 12. The boom 11, the arm 12, and the bucket 13 are driven by a boom cylinder 15, an arm cylinder 16, and a bucket cylinder 17, respectively, which are hydraulic actuators.

For example, the lower travel structure 4 includes crawler-type travel devices 19 on its left and right sides (only the left side is depicted). The travel devices 19 are driven by travel hydraulic motors 19*a* which are hydraulic actuators.

For example, the upper swing structure 5 is swing-driven relative to the lower travel structure 4 by a swing hydraulic motor (not depicted) which is a hydraulic actuator. The upper swing structure 5 includes an operation room 21 into which a worker gets, a housing 22 that houses various types of equipment, and a counter weight 23 attached to a rear end of the housing 22. The counter weight 23 counterbalances the weight of the front work implement 2. An operation device 31 and a gate lock device 32 mentioned later (see FIG. 2 mentioned later) and the like are arranged in the operation room 21. The housing 22 houses various types of equipment of a hydraulic system 30 (see FIG. 2 mentioned later) for operating the front work implement 2 and the body 3 (lower travel structure 4 and upper swing structure 5), for example. Details of the configuration of the hydraulic system 30 will be mentioned later.

Stairs 25 for allowing a worker to get into and out of the hydraulic excavator 1 are installed on the back of the upper swing structure 5. The stairs 25 are configured to be switchable between an extended state (state depicted in FIG. 1) and a retracted state (not depicted). In the extended state, stairs 25 extend from the position of a lower end portion of the hydraulic excavator 1 to the height position of the operation room 21, thereby allowing a worker to get into and out of the operation room 21. In the retracted state, the stairs 25 are retracted so as not to interrupt work of the hydraulic excavator 1. A stair operation switch 26 for switching the stairs 25 to either the extended state or the retracted state is disposed in the housing 22 of the upper swing structure 5. The stairs 25 are configured to be switched to the extended state or the retracted state by not only the switching operation of the stair operation switch 26 but also a remote controller (not depicted).

Figure 2:
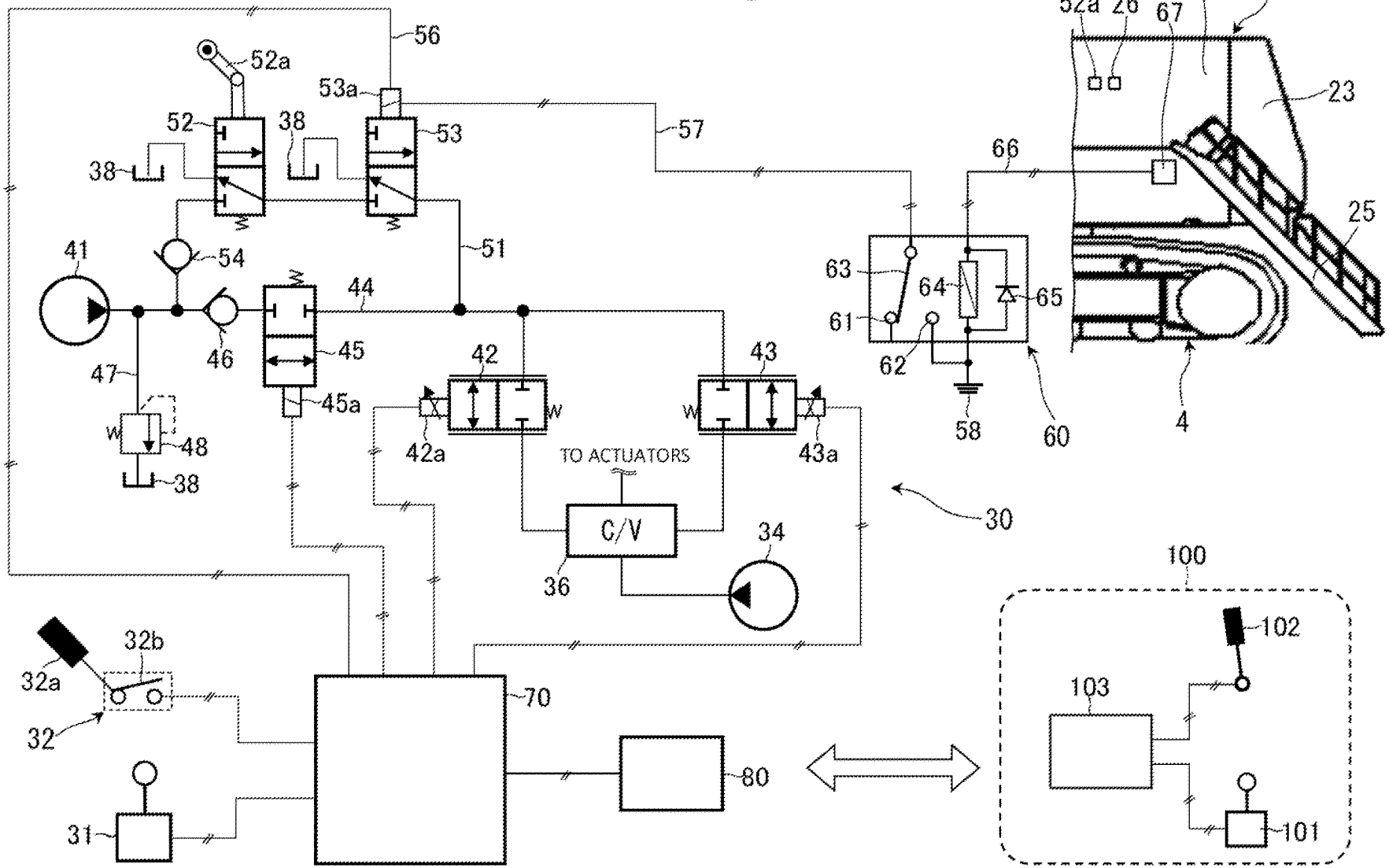
FIG. 2 is a schematic diagram depicting a hydraulic system in the work machine according to the first embodiment of the present invention.

Next, the configuration of the hydraulic system in the work machine according to the first embodiment of the present invention is explained by using FIG. 2. FIG. 2 is a schematic diagram depicting the hydraulic system in the work machine according to the first embodiment of the present invention. Note that, in order to avoid complicated explanation, FIG. 2 depicts a hydraulic system that drives only one of a plurality of hydraulic actuators.

In FIG. 2, the hydraulic system 30 controls driving of various hydraulic actuators according to the operation of the operation device 31 and the gate lock device 32 arranged in the operation room 21. Further, the hydraulic system 30 controls driving of various hydraulic actuators according to remote operation signals transmitted from the remote operation apparatus 100.

The operation device 31 gives instructions for driving of various hydraulic actuators according to an operation made by an operator. For example, the operation device 31 is an electric operation lever device that has an operation lever that can be inclined, and that senses an operation amount of the operation lever and outputs an electric signal corresponding to the sensed operation amount. The electric operation device 31 is electrically connected to a controller 70 via a signal line, and outputs an operation signal (electric signal) corresponding to the operation (operation direction and operation amount) to the controller 70.

The gate lock device 32 gives an instruction for either enabling or disabling of the instruction from the operation device 31. The gate lock device 32 has a gate lock lever 32*a* and a gate lock switch 32*b*. The gate lock lever 32*a* can be switched to a lock position for opening an door way of the operation room 21 or an unlock position for blocking the door way of the operation room 21. The gate lock switch 32*b* switches a signal circuit to an opened state or a closed state in conjunction with the operation of the gate lock lever 32*a*. The gate lock device 32 is electrically connected to the controller 70 via a signal line, and outputs an instruction (operation signal) according to an operation position (lock position or unlock position) of the gate lock lever 32*a* to the controller 70. For example, when the gate lock lever 32*a* has been switched to the lock position, the gate lock switch 32*b* is in an opened state (off), and the gate lock device 32 outputs, to the controller 70, an instruction (OFF signal) for disabling of the instruction from the operation device 31. On the other hand, when the gate lock lever 32*a* has been switched to the unlock position, the gate lock switch 32*b* is in a closed state (on), and the gate lock device 32 outputs, to the controller 70, an instruction (ON signal) for enabling of the instruction from the operation device 31. The gate lock device 32 is an operation device for operating a first gate lock valve 45 mentioned later.

The remote operation apparatus 100 includes a remote-operation operation lever 101 and a remote-operation gate lock lever 102 having functionalities similar to those of the operation device 31 and the gate lock device 32 mentioned above. That is, the remote-operation operation lever 101 is used to remotely operate various hydraulic actuators according to an operation made by an operator. The remote-operation operation lever 101 is electrically connected to a wireless communication device 103 via a signal line, and outputs a first remote operation signal corresponding to an operation direction and an operation amount to the wireless communication device 103. The remote-operation gate lock lever 102 can be switched to either one of the operation positions, i.e., a lock position and an unlock position, and gives an instruction for either disabling or enabling of the remote operation by the remote-operation operation lever 101 according to its operation position. The remote-operation gate lock lever 102 is electrically connected to the wireless communication device 103 via a signal line, and outputs a second remote operation signal corresponding to the operation position, i.e., either the lock position or the unlock position, to the wireless communication device 103. The remote-operation gate lock lever 102 outputs the second remote operation signal (lock signal) that gives an instruction for disabling of the remote operation, when the remote-operation gate lock lever 102 has been switched to the lock position. On the other hand, the remote-operation gate lock lever 102 outputs the second remote operation signal (unlock signal) that gives an instruction for enabling of the remote operation, when the remote-operation gate lock lever 102 has been switched to the unlock position. The wireless communication device 103 transmits a remote operation signal including the first remote operation signal of the remote-operation operation lever 101 and the second remote operation signal of the remote-operation gate lock lever 102, to the hydraulic excavator 1 that is to be remotely operated.

The hydraulic system 30 includes a wireless communication device 80 that receives the remote operation signal transmitted from the wireless communication device 103 of the remote operation apparatus 100. The wireless communication device 80 is electrically connected to the controller 70 via a signal line, and outputs the remote operation signal received from the remote operation apparatus 100 to the controller 70.

The hydraulic system 30 includes a main pump 34 as a hydraulic fluid source, various hydraulic actuators (not depicted in FIG. 2) driven by a hydraulic fluid supplied from the main pump 34, and control valves 36 (only one of them is depicted) that control the flow of the hydraulic fluid supplied from the main pump 34 to the hydraulic actuators. For example, the hydraulic actuators are the boom cylinder 15, the arm cylinder 16, the bucket cylinder 17, the travel hydraulic motors 19*a* (see FIG. 1 about all of them), the swing hydraulic motor (not depicted), and the like. The control valves 36 are hydraulic-pilot type control valves, and are drive-controlled according to the magnitudes of pilot pressures that act on their pressure-receiving parts.

The hydraulic system 30 includes a pilot pump 41 as a pilot hydraulic fluid source, and pilot valves 42 and 43 that generate pilot pressures by using a delivery pressure of the pilot pump 41 as a source pressure. The pilot pump 41 is connected with the pilot valves 42 and 43 via a first pilot line 44, and the first pilot line 44 introduces a hydraulic fluid delivered from the pilot pump 41 to the pilot valves 42 and 43. For example, the pilot valves 42 and 43 are solenoid proportional valves and have excitation coils 42*a* and 43*a*. The excitation coils 42*a* and 43*a* of the pilot valves 42 and 43 are electrically connected with the controller 70 via signal lines, and the openings of the pilot valves 42 and 43 are controlled by control signals (excitation currents) from the controller 70. The pilot valves 42 and 43 generate pilot pressures by reducing the delivery pressure of the pilot pump 41 according to the operation (operation direction and operation amount) of the operation device 31, and output the generated pilot pressures to the pressure-receiving parts of the control valves 36.

The first gate lock valve 45 is disposed on the first pilot line 44, and switches the first pilot line 44 to either a communication state or an interruption state. In other words, the first gate lock valve 45 is switched to either an open position for allowing the supply of the hydraulic fluid from the pilot pump 41 (pilot hydraulic fluid source) to the pilot valves 42 and 43 via the first pilot line 44 or a closed position for interrupting the supply of the hydraulic fluid from the pilot pump 41 to the pilot valves 42 and 43 via the first pilot line 44. The first gate lock valve 45 is switched to the closed position which causes the first pilot line 44 to be in the interruption state, when the gate lock lever 32*a* of the gate lock device 32 is switched to the lock position. On the other hand, the first gate lock valve 45 is switched to the open position which causes the first pilot line 44 to be in the communication state, when the gate lock lever 32*a* is switched to the unlock position. For example, the first gate lock valve 45 is a solenoid valve and has an excitation coil 45*a*. The excitation coil 45*a* of the first gate lock valve 45 is electrically connected with the controller 70 via a signal line, and the first gate lock valve 45 is switched to the open position or the closed position according to a control signal (excitation current) from the controller 70. For example, the first gate lock valve 45 is normally closed.

A first check valve 46 is disposed upstream of the first gate lock valve 45 on the first pilot line 44. The first check valve 46 allows the flow of the hydraulic fluid from the pilot pump 41 to the first gate lock valve 45 but prevents the flow of the hydraulic fluid from the first gate lock valve 45 to the pilot pump 41.

A pilot relief line 47 branches off from the first pilot line 44 at a point upstream of the first check valve 46. The pilot relief line 47 introduces the hydraulic fluid from the pilot pump 41 to a hydraulic operation fluid tank 38. A pilot relief valve 48 is disposed on the pilot relief line 47. The pilot relief valve 48 is a valve for keeping, at an approximately constant predetermined value, the delivery pressure of the pilot pump 41 to be input to the pilot valves 42 and 43. The pilot relief valve 48 opens when the pressure of the first pilot line 44 exceeds the predetermined value (relief set pressure) set in advance, and releases the hydraulic fluid of the first pilot line 44 to the hydraulic operation fluid tank 38 via the pilot relief line 47.

As a hydraulic circuit for a remote operation by the remote operation apparatus 100, the hydraulic system 30 further includes a second pilot line 51 that introduces the hydraulic fluid from the pilot pump 41 to the pilot valves 42 and 43 bypassing the first gate lock valve 45, and an operation mode selector valve 52 and a second gate lock valve 53 that are disposed on the second pilot line 51. One side of the second pilot line 51 is connected to a part of the first pilot line 44 upstream of the first check valve 46, and the other side of the second pilot line 51 is connected to a part of the first pilot line 44 between the first gate lock valve 45 and the pilot valves 42 and 43. The operation mode selector valve 52 is disposed upstream of the second gate lock valve 53. A second check valve 54 is disposed upstream of the operation mode selector valve 52 on the second pilot line 51. The second check valve 54 allows the flow of the hydraulic fluid from the pilot pump 41 to the operation mode selector valve 52 but prevents the flow of the hydraulic fluid from the operation mode selector valve 52 to the pilot pump 41.

The operation mode selector valve 52 is used to switch whether to allow or disable the remote operation of the hydraulic excavator 1 (hydraulic system 30) by the remote operation apparatus 100. The operation mode selector valve 52 is switched to either an open position for allowing the supply of the hydraulic fluid from the pilot pump 41 (pilot hydraulic fluid source) to the pilot valves 42 and 43 via the second pilot line 51 or a closed position for interrupting the supply of the hydraulic fluid from the pilot pump 41 to the pilot valves 42 and 43 via the second pilot line 51. Specifically, when the operation mode selector valve 52 is at the open position, communication between a part of the second pilot line 51 on the upstream side of the operation mode selector valve 52 and a part of the second pilot line 51 on the downstream side of the operation mode selector valve 52 is established. When the operation mode selector valve 52 is at the closed position, communication with the part of the second pilot line 51 on the upstream side of the operation mode selector valve 52 is interrupted, and the part of the second pilot line 51 on the downstream side of the operation mode selector valve 52 is made to communicate with the hydraulic operation fluid tank 38.

In addition, the operation mode selector valve 52 is switched to the closed position or the open position manually by an operator, and has an operation part 52*a* that is switched by a worker manually. For example, the operation part 52*a* is arranged near the stair operation switch 26 on the housing 22 (see FIG. 1). The operation part 52*a* functions as an operation mode selector that is switched manually by a worker to either an operation position for a remote operation mode or an operation position for an in-machine operation mode. The remote operation mode represents a mode for the remote operation by the remote operation apparatus 100. The in-machine operation mode represents a mode for an operation by a worker who is in the operation room 21 (the remote operation by the remote operation apparatus 100 is disabled). When the operation part 52*a* as the operation mode selector is switched to the in-machine operation mode, the operation mode selector valve 52 is switched to the closed position in conjunction with the switching operation of the operation part 52*a*. On the other hand, when the operation part 52*a* is switched to the remote operation mode, the operation mode selector valve 52 is switched to the open position in conjunction with the switching operation of the operation part 52*a*.

Opening and closing of the second gate lock valve 53 are basically controlled according to the operation position of the remote-operation gate lock lever 102 (second remote operation signal) of the remote operation apparatus 100. The second gate lock valve 53 is switched to either an open position for allowing the supply of the hydraulic fluid from the pilot pump 41 (pilot hydraulic fluid source) to the pilot valves 42 and 43 via the second pilot line 51 or a closed position for interrupting the supply of the hydraulic fluid from the pilot pump 41 to the pilot valves 42 and 43 via the second pilot line 51. Specifically, when the second gate lock valve 53 is at the open position, communication between a part of the second pilot line 51 on the upstream side of the second gate lock valve 53 and a part of the second pilot line 51 on the downstream side of the second gate lock valve 53 is established. When the second gate lock valve 53 is at the closed position, communication with the part of the second pilot line 51 on the upstream side of the second gate lock valve 53 is interrupted, and the part of the second pilot line 51 on the downstream side of the second gate lock valve 53 is made to communicate with the hydraulic operation fluid tank 38. Normally, the second gate lock valve 53 is switched to the closed position when the remote-operation gate lock lever 102 is switched to the lock position, and is switched to the open position when the remote-operation gate lock lever 102 is switched to the unlock position. For example, the second gate lock valve 53 is a solenoid valve and has an excitation coil 53*a*. The second gate lock valve 53 is switched to the closed position or the open position according to a control signal (excitation current) from the controller 70 to the excitation coil 53*a*. For example, the second gate lock valve 53 is normally closed. One side of the excitation coil 53*a* of the second gate lock valve 53 is electrically connected with the controller 70 via a signal line 56, and the other side of the excitation coil 53*a* is electrically connected to a ground (earth) 58 via a signal line 57 and a signal circuit switching device 60. That is, a signal circuit for outputting a control signal of the controller 70 to the excitation coil 53*a* of the second gate lock valve 53 includes the signal line 56, the signal line 57, the signal circuit switching device 60, and the ground 58 (earth).

The signal circuit switching device 60 switches the signal circuit for controlling the second gate lock valve 53 to either a connection state or a disconnection state. The signal circuit switching device 60 switches the signal circuit to the disconnection state when the stairs 25 are in the extended state, and switches the signal circuit to the connection state when the stairs 25 are in the retracted state.

For example, the signal circuit switching device 60 is a relay. The relay 60 as the signal circuit switching device has a first fixed contact point 61 and a second fixed contact point 62, a movable contact point 63 that is driven to come into contact with either the first fixed contact point 61 or the second fixed contact point 62, a relay coil 64 that drives the movable contact point 63, and a diode 65 connected in parallel with the relay coil 64. The diode 65 releases counter electromotive force that is generated when an electric current flows through the relay coil 64 and the relay coil 64 is then excited.

The first fixed contact point 61 is electrically opened, while the second fixed contact point 62 is electrically connected to the ground 58. The movable contact point 63 is electrically connected with the excitation coil 53*a* of the second gate lock valve 53 via the signal line 57. One side of the relay coil 64 is connected to the ground 58, and the other side of the relay coil 64 is electrically connected with a stair retraction sensor 67 via a signal line 66.

The stair retraction sensor 67 senses the retracted state of the stairs 25, and outputs a sensing signal to the relay 60 as the signal circuit switching device. For example, the stair retraction sensor 67 is configured as a switch that is switched to an ON state when the retracted state of the stairs 25 is sensed, and that is switched to an OFF state when the retracted state of the stairs 25 is not sensed (the extended state is sensed). That is, the stair retraction sensor 67 functions as a switch that switches the relay coil 64 to a current-carrying state or a non-current-carrying state according to the retracted state or the extended state of the stairs 25. The stair retraction sensor 67 causes a current to flow through the relay coil 64 only when sensing the retracted state of the stairs 25.

For example, the relay 60 is normally opened, and is configured such that the movable contact point 63 is brought into contact with the second fixed contact point 62 from the first fixed contact point 61 when the current flows through the relay coil 64. That is, the relay 60 switches, when the stairs 25 are in the extended state, the signal circuit for the second gate lock valve 53 to the disconnection state due to no current flowing through the relay coil 64 by the stair retraction sensor 67 (switch off). On the other hand, the relay 60 switches, when the stairs 25 are in the retracted state, the signal circuit to the connection state due to the current flowing through the relay coil 64 by the stair retraction sensor 67 (switch on). In other words, the relay 60 disables the control of the opening and closing of the second gate lock valve 53 by the controller 70 (remote-operation gate lock lever 102) when the stairs 25 are in the extended state, and allows the control of the opening and closing of the second gate lock valve 53 by the controller 70 (remote-operation gate lock lever 102) when the stairs 25 are in the retracted state.

The controller 70 controls the openings of the pilot valves 42 and 43 according to the operation (operation direction and operation amount) of the operation device 31, and also controls the opening and closing of the first gate lock valve 45 according to the operation (lock position or unlock position) of the gate lock device 32. Further, the controller 70 controls the openings of the pilot valves 42 and 43 according to the operation (operation direction and operation amount) of the remote-operation operation lever 101 of the remote operation apparatus 100, and also controls the opening and closing of the second gate lock valve 53 according to the operation (lock position or unlock position) of the remote-operation gate lock lever 102. The controller 70 receives, via the wireless communication device 80, input of the remote operation signal including the first remote operation signal of the remote-operation operation lever 101 and the second remote operation signal of the remote-operation gate lock lever 102.

Figure 3:
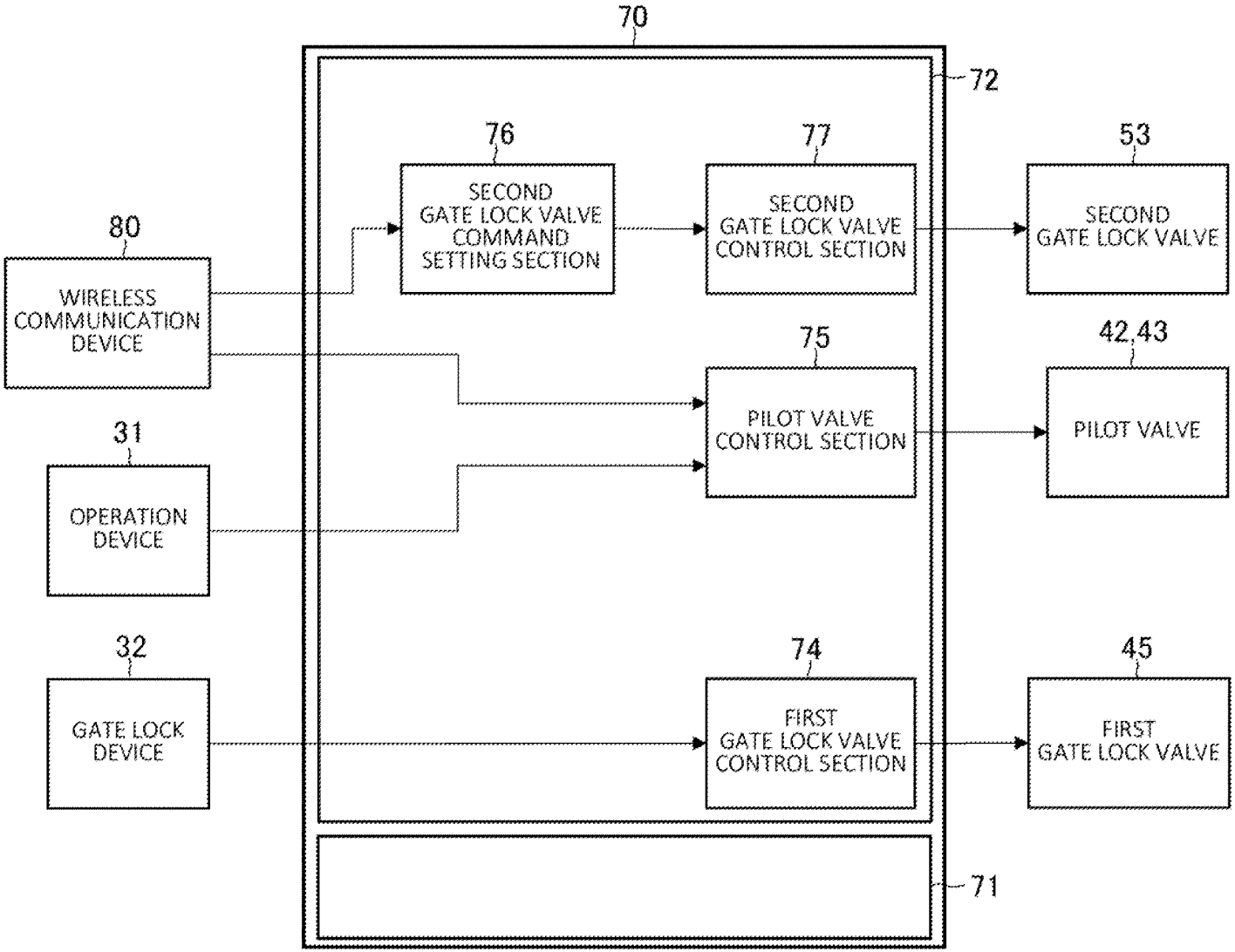
FIG. 3 is a block diagram depicting the functional configuration of a controller included in the work machine according to the first embodiment of the present invention depicted in FIG. 2.
Figure 4:
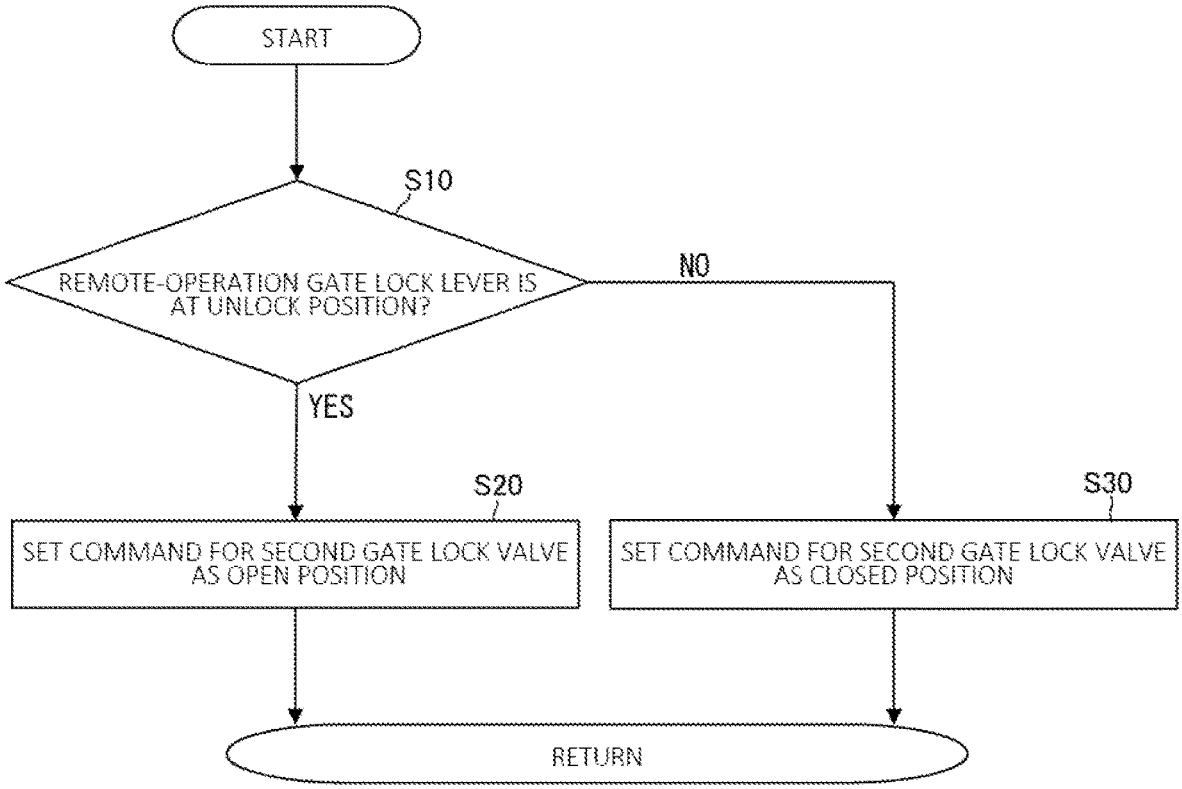
FIG. 4 is a flowchart depicting an example of a processing procedure by a second gate lock valve command setting section in the controller depicted in FIG. 3.

Next, functionalities of the controller included in the work machine according to the first embodiment of the present invention are explained by using FIG. 3 and FIG. 4. FIG. 3 is a block diagram depicting the functional configuration of the controller included in the work machine according to the first embodiment of the present invention depicted in FIG. 2. FIG. 4 is a flowchart depicting an example of a processing procedure by a second gate lock valve command setting section in the controller depicted in FIG. 3.

In FIG. 3, the controller 70 includes, as hardware configuration, a storage device 71 and a processor 72. The storage device 71 includes, for example, a RAM, a ROM, and the like. The processor 72 includes a CPU, an MPU, or the like. The storage device 71 has stored in advance thereon a program and various types of information necessary for control of the operation of the hydraulic excavator 1. The processor 72 reads in a program and various types of information from the storage device 71 as appropriate and executes processes according to the program, to thereby implement various functionalities including the following functionalities.

The controller 70 has, as functionalities executed by the processor 72, a first gate lock valve control section 74, a pilot valve control section 75, a second gate lock valve command setting section 76, and a second gate lock valve control section 77.

The first gate lock valve control section 74 sets, as a command for the first gate lock valve 45, either the closed position or the open position on the basis of an operation signal (OFF signal or ON signal of the gate lock switch 32*b*) output from the gate lock device 32 according to the operation position (lock position or unlock position) of the gate lock lever 32*a*, and outputs a control signal (excitation current) corresponding to the set command (closed position or open position) to the first gate lock valve 45 (excitation coil 45*a*). The first gate lock valve control section 74 sets the command for the first gate lock valve 45 as the open position, when the operation position of the gate lock lever 32*a* is the lock position (when the operation signal is the OFF signal of the gate lock switch 32*b*), and sets the command for the first gate lock valve 45 as the closed position, when the operation position is the unlock position (when the operation signal is the ON signal of the gate lock switch 32*b*).

The pilot valve control section 75 sets commands for the openings (driving) of the pilot valves 42 and 43 on the basis of an operation signal (operation direction and operation amount) output from the operation device 31. In addition, the pilot valve control section 75 sets commands for the openings (driving) of the pilot valves 42 and 43 on the basis of the first remote operation signal (operation direction and operation amount) of the remote-operation operation lever 101 output from the wireless communication device 80. The pilot valve control section 75 outputs a control signal (excitation current) corresponding to the set command to each of the pilot valves 42 and 43 (excitation coils 42*a* and 43*a*).

The second gate lock valve command setting section 76 sets, as a command for the second gate lock valve 53, either the open position or the closed position on the basis of the second remote operation signal (lock position or unlock position) of the remote-operation gate lock lever 102 output from the wireless communication device 80. Specifically, the second gate lock valve command setting section 76 sets the command according to the flowchart depicted in FIG. 4, for example. First, the second gate lock valve command setting section 76 determines whether or not the remote-operation gate lock lever 102 is at the unlock position, on the basis of the second remote operation signal of the remote-operation gate lock lever 102 output from the wireless communication device 80 (Step S10 in FIG. 4). When it is determined in Step S10 that the remote-operation gate lock lever 102 is at the unlock position (YES), a command for the second gate lock valve 53 is set as the open position (Step S20 in FIG. 4). On the other hand, when it is determined in Step S10 that the remote-operation gate lock lever 102 is at the lock position (NO), a command for the second gate lock valve 53 is set as the closed position (Step S30 in FIG. 4).

Returning to FIG. 3, the second gate lock valve control section 77 outputs a control signal (excitation current) corresponding to the command (open position or closed position) set by the second gate lock valve command setting section 76, to the second gate lock valve 53 (excitation coil 53*a*).

Next, the operation and advantages of the work machine according to the first embodiment of the present invention are explained by using FIG. 1 to FIG. 3. First, a case where a worker gets into the operation room 21 of the hydraulic excavator 1 and operates the hydraulic excavator 1 is explained.

The worker gets into the hydraulic excavator 1 depicted in FIG. 1 by using the stairs 25 in the extended state, and retracts the stairs 25 by operating the stair operation switch 26. At this time, the operation part 52*a* of the operation mode selector valve 52 as the operation mode selector is switched to the in-machine operation mode. Because of this, the operation mode selector valve 52 depicted in FIG. 2 is at the closed position corresponding to the operation position of the operation part 52*a* for the in-machine operation mode. Therefore, the supply of the hydraulic fluid from the pilot pump 41 to the pilot valves 42 and 43 via the second pilot line 51 is interrupted, and this disables the remote operation by the remote operation apparatus.

Next, the worker operates the gate lock lever 32*a* of the gate lock device 32 in the operation room 21 such that the gate lock lever 32*a* is switched from the lock position to the unlock position, and gets seated. When the gate lock lever 32*a* is switched to the unlock position, the gate lock switch 32*b* is switched from the opened state to the closed state. Accordingly, an ON signal (instruction for enabling of the instruction from the operation device 31) from the gate lock device 32 is input to the controller 70. The controller 70 (first gate lock valve control section 74) depicted in FIG. 3 sets the open position as a command to the first gate lock valve 45 based on the ON signal from the gate lock device 32, and outputs, to the first gate lock valve 45, a control signal (excitation current) corresponding to the command set as the open position.

Accordingly, the first gate lock valve 45, which is normally closed, in the hydraulic system 30 depicted in FIG. 2 is switched to the open position, and the first pilot line 44 becomes in the communication state. In this case, the hydraulic fluid from the pilot pump 41 is supplied to the pilot valves 42 and 43 via the first check valve 46 and the first gate lock valve 45 at the open position on the first pilot line 44, and the delivery pressure of the pilot pump 41 is input to the pilot valves 42 and 43.

When the operation device 31 is operated by the worker in this state, the operation device 31 outputs, to the controller 70, an operation signal (instruction for driving of the hydraulic actuators) corresponding to an operation direction and an operation amount. The controller 70 (pilot valve control section 75) depicted in FIG. 3 sets commands for the openings of the pilot valves 42 and 43 on the basis of the operation signal from the operation device 31, and outputs control signals (excitation currents) corresponding to the set commands to the pilot valves 42 and 43.

Accordingly, the openings of the pilot valves 42 and 43 depicted in FIG. 2 are controlled, and the pilot valves 42 and 43 reduce the delivery pressure of the pilot pump 41 according to the controlled openings, to generate pilot pressures. The pilot pressures generated by the pilot valves 42 and 43 act on the pressure-receiving parts of the control valves 36, and the control valves 36 are drive-controlled according to the pilot pressures. Accordingly, the hydraulic fluid from the main pump 34 is supplied to hydraulic actuators (the boom cylinder 15, the arm cylinder 16, the bucket cylinder 17, and the travel hydraulic motors 19*a* which are depicted in FIG. 1, or the swing hydraulic motor (not depicted), for example) via the control valves 36, and the hydraulic actuators are thus drive-controlled.

Next, a case where the hydraulic excavator is remotely operated is explained.

In order to remotely operate the hydraulic excavator 1 by the remote operation apparatus 100 depicted in FIG. 2, the power supplies of the controller 70 and the wireless communication device 80 need to be turned on. Further, the operation part 52*a* of the operation mode selector valve 52 as the operation mode selector needs to be switched from the in-machine operation mode to the remote operation mode.

Hence, the worker gets into the hydraulic excavator 1 depicted in FIG. 1 by using the stairs 25 in the extended state, switches manually the operation part 52*a* of the operation mode selector valve 52, which is disposed on the housing 22, from the in-machine operation mode to the remote operation mode, and also turns on the power supplies of the controller 70 and the wireless communication device 80 depicted in FIG. 2. Then, after getting out of the hydraulic excavator 1 by using the stairs 25, the worker retracts the stairs 25 by operating a remote controller. Note that, in the present embodiment, a case where placing the first gate lock valve 45 at the closed position is one condition that has to be satisfied to start the remote operation of the hydraulic excavator 1 will be explained. Hence, when the worker gets out of the hydraulic excavator 1, the first gate lock valve 45 is at the closed position.

When the operation part 52*a* of the operation mode selector valve 52 is switched to the remote operation mode, the operation mode selector valve 52 is switched to the open position corresponding to the operation position for the remote operation mode. Accordingly, communication between the part of the second pilot line 51 on the upstream side of the operation mode selector valve 52 and the part of the second pilot line 51 on the downstream side of the operation mode selector valve 52 is established.

In addition, when the stairs 25 are retracted, the stair retraction sensor 67 senses the retracted state of the stairs 25 and outputs a sensing signal (excitation current) corresponding to the retracted state of the stairs 25 to the relay coil 64 of the relay 60. This brings the movable contact point 63 into contact with the second fixed contact point 62 from the first fixed contact point 61. This driving of the relay 60 switches the signal circuit (signal line 56, signal line 57, excitation coil 53*a*, relay 60, and ground 58) for controlling the second gate lock valve 53, from the disconnection state to the connection state. That is, the retraction of the stairs 25 enables the control of the opening and closing of the second gate lock valve 53 by the controller 70.

Thereafter, when the remote-operation gate lock lever 102 of the remote operation apparatus 100 is switched from the lock position to the unlock position by an operator, the wireless communication device 103 of the remote operation apparatus 100 transmits the second remote operation signal (unlock signal) of the remote-operation gate lock lever 102. The unlock signal (second remote operation signal) of the remote-operation gate lock lever 102 transmitted from the wireless communication device 103 is received by the wireless communication device 80 of the hydraulic excavator 1.

The wireless communication device 80 outputs the received unlock signal of the remote-operation gate lock lever 102 to the controller 70. The controller 70 (second gate lock valve command setting section 76) depicted in FIG. 3 sets a command for the second gate lock valve 53 as the open position on the basis of the unlock signal (second remote operation signal) of the remote-operation gate lock lever 102 from the wireless communication device 80.

At this time, since the relay 60 depicted in FIG. 2 is actuated as a result of the retraction of the stairs 25 as mentioned above, the signal circuit for the second gate lock valve 53 is in the connection state, and the control of the opening and closing of the second gate lock valve 53 by the controller 70 is enabled. Accordingly, the controller 70 (second gate lock valve control section 77) depicted in FIG. 3 can output, to the second gate lock valve 53, a control signal (excitation current) corresponding to the command for the second gate lock valve 53 set as the open position by second gate lock valve command setting section 76. Thus, the second gate lock valve 53, which is normally closed, is switched to the open position.

When the operation mode selector valve 52 is switched to the open position and the second gate lock valve 53 is switched to the open position, the second pilot line 51 becomes in the communication state. In this case, even if the first gate lock valve 45 is at the closed position, the hydraulic fluid from the pilot pump 41 is supplied to the pilot valves 42 and 43 via the second check valve 54, the operation mode selector valve 52 at the open position, and the second gate lock valve 53 at the open position on the second pilot line 51, and the delivery pressure of the pilot pump 41 is input to the pilot valves 42 and 43.

When the remote-operation operation lever 101 of the remote operation apparatus 100 is operated by the operator in this state, the wireless communication device 80 of the hydraulic excavator 1 receives the first remote operation signal (operation direction and operation amount) of the remote-operation operation lever 101 transmitted from the wireless communication device 103 of the remote operation apparatus 100, and outputs the first remote operation signal to the controller 70. The controller 70 (pilot valve control section 75) depicted in FIG. 3 sets commands for the openings of the pilot valves 42 and 43 based on the first remote operation signal of the remote-operation operation lever 101 from the wireless communication device 80, and outputs control signals (excitation currents) corresponding to the set commands to the respective pilot valves 42 and 43.

Accordingly, the openings of the pilot valves 42 and 43 depicted in FIG. 2 are controlled. At this time, as mentioned above, the pilot valves 42 and 43 receive the delivery pressure of the pilot pump 41 via the second pilot line 51. Accordingly, the pilot valves 42 and 43 can reduce the delivery pressure of the pilot pump 41 according to the controlled openings, and generate pilot pressures. The pilot pressures generated by the pilot valves 42 and 43 act on the pressure-receiving parts of the control valves 36, and the control valves 36 are drive-controlled according to the pilot pressures. Thus, the hydraulic fluid from the main pump 34 is supplied to hydraulic actuators via the control valves 36, and the hydraulic actuators are drive-controlled.

In this manner, on the premise that the operation part 52*a* of the operation mode selector valve 52 as the operation mode selector is manually switched to the remote operation mode, the hydraulic excavator 1 can be actuated through the remote operation by the remote operation apparatus 100 when the stairs 25 are in the retracted state.

Now, assumed is a case where, after a worker gets into the hydraulic excavator 1 by using the stairs 25 in the extended state and switches the operation part 52*a* of the operation mode selector valve 52 to the remote operation mode but before the worker gets out of the hydraulic excavator 1, an operator undesirably operates the remote operation apparatus 100. In this case, the stairs 25 are still in the extended state. Because of this, the stair retraction sensor 67 has sensed the extended state of the stairs 25, and outputs a sensing signal (OFF signal) corresponding to the extended state of the stairs 25 to the relay coil 64 of the relay 60. Accordingly, the relay 60 is not actuated, and the movable contact point 63 of the relay 60 remains in contact with the first fixed contact point 61. That is, the signal circuit (signal line 56, signal line 57, excitation coil 53*a*, relay 60, and ground 58) for controlling the second gate lock valve 53 is still in the disconnection state due to the relay 60.

When the remote-operation gate lock lever 102 of the remote operation apparatus 100 is switched to the unlock position in this state, the controller 70 sets the open position as a command for the second gate lock valve 53 based on the unlock signal (second remote operation signal) of the remote-operation gate lock lever 102 received by the wireless communication device 80. Further, the controller 70 is to output, to the second gate lock valve 53, a control signal (excitation current) corresponding to the command set as the open position.

However, when the stairs 25 are in the extended state as mentioned above, the signal circuit for the second gate lock valve 53 is in the disconnection state due to the relay 60. Accordingly, the control signal (excitation current) from the controller 70 cannot be input to the second gate lock valve 53, and the control of the opening and closing of the second gate lock valve 53 by the controller 70 cannot be performed. Because of this, the second gate lock valve 53, which is normally closed, is kept at the closed position. That is, the operation for switching the remote-operation gate lock lever 102 to the unlock position is ignored and the second gate lock valve 53 is kept at the closed position. Since the second gate lock valve 53 is at the closed position, the hydraulic fluid from the pilot pump 41 cannot be supplied to the pilot valves 42 and 43 via the second pilot line 51.

When the remote-operation operation lever 101 of the remote operation apparatus 100 is operated at this time, the controller 70 outputs, to the respective pilot valves 42 and 43, control signals (excitation currents) corresponding to the commands for the openings set on the basis of the first remote operation signal of the remote-operation operation lever 101. However, since the hydraulic fluid from the pilot pump 41 cannot be supplied to the pilot valves 42 and 43 when the second gate lock valve 53 is at the closed position, the control valves 36 cannot be driven even if the openings of the pilot valves 42 and 43 are controlled by the controller 70. Because of this, the hydraulic actuators are not driven.

In this manner, in the present embodiment, the remote operation of the hydraulic excavator 1 by the remote operation apparatus 100 cannot be executed when the stairs 25 are in the extended state. Accordingly, it is possible to prevent a situation where, after a worker gets into the hydraulic excavator 1 by using the stairs 25 in the extended state, the worker becomes unable to get out of the hydraulic excavator 1 due to the remote operation by the remote operation apparatus 100.

In addition, in the present embodiment, execution of the remote operation of the hydraulic excavator 1 by the remote operation apparatus 100 is disabled unless the operation part 52*a* of the operation mode selector valve 52 is manually switched to the remote operation mode. The operation mode selector valve 52 is at the closed position when the operation part 52*a* of the operation mode selector valve 52 is at the operation position for the in-machine operation mode, and the second pilot line 51 is thus in the interruption state. Because of this, even if the stairs 25 are in the retracted state and the control of the opening and closing of the second gate lock valve 53 by the controller 70 is enabled, the hydraulic fluid from the pilot pump 41 cannot be supplied to the pilot valves 42 and 43 via the second pilot line 51 since the operation mode selector valve 52 is at the closed position.

As mentioned above, the hydraulic excavator 1 (work machine) according to the first embodiment of the present invention includes the operation room 21 into which a worker gets; the stairs 25 that are switchable between the extended state where the worker is allowed to get into and out of the operation room 21 and the retracted state where the stairs 25 are retracted so as not to interrupt work; the hydraulic actuators 15, 16, 17, and 19*a* that are driven by supply of the hydraulic fluid; the hydraulic-pilot type control valves 36 that control the flow of the hydraulic fluid supplied to the hydraulic actuators 15, 16, 17, and 19*a*; the pilot valves 42 and 43 that generate pilot pressures for driving the control valves 36, by using a pressure from the pilot pump 41 (pilot hydraulic fluid source) as a source pressure; the first pilot line 44 that introduces the hydraulic fluid from the pilot pump 41 (pilot hydraulic fluid source) to the pilot valves 42 and 43; the first gate lock valve 45 that is disposed on the first pilot line 44 and that is configured to be switched to either the open position for allowing the supply of the hydraulic fluid from the pilot pump 41 (pilot hydraulic fluid source) to the pilot valves 42 and 43 or the closed position for interrupting the supply of the hydraulic fluid from the pilot pump 41 (pilot hydraulic fluid source) to the pilot valves 42 and 43; the operation device 31 (first operation device) that is arranged in the operation room 21 and that is used to operate the hydraulic actuators 15, 16, 17, and 19*a*; and the gate lock device 32 (first gate lock device) that is arranged in the operation room 21 and that is used to operate the first gate lock valve 45. The hydraulic excavator 1 is capable of being remotely operated by the remote operation apparatus 100 at a location away from the operation room 21. In addition, the hydraulic excavator 1 (work machine) includes the second pilot line 51 that introduces the hydraulic fluid from the pilot pump 41 (pilot hydraulic fluid source) to the pilot valves 42 and 43 bypassing the first gate lock valve 45; the second gate lock valve 53 that is disposed on the second pilot line 51 and that is switched to either the open position for allowing the supply of the hydraulic fluid from the pilot pump 41 (pilot hydraulic fluid source) to the pilot valves 42 and 43 or the closed position for interrupting the supply of the hydraulic fluid from the pilot pump 41 (pilot hydraulic fluid source) to the pilot valves 42 and 43; the operation part 52*a* of the operation mode selector valve 52 as the operation mode selector that is switched manually by the worker to either an operation position for the remote operation mode representing the remote operation by the remote operation apparatus 100 or an operation position for the in-machine operation mode representing an operation by the worker in the operation room 21; the operation mode selector valve 52 (selector valve) that is disposed on the second pilot line 51 and that is switched, by the switching operation of the operation part 52*a* (operation mode selector), to either the open position for allowing the supply of the hydraulic fluid from the pilot pump 41 (pilot hydraulic fluid source) to the pilot valves 42 and 43 or the closed position for interrupting the supply of the hydraulic fluid from the pilot pump 41 (pilot hydraulic fluid source) to the pilot valves 42 and 43; and the controller 70 that controls the second gate lock valve 53 such that the second gate lock valve 53 is caused to be at either the open position or the closed position on the basis of the second remote operation signal transmitted by the remote operation apparatus 100 and that controls the openings of the pilot valves 42 and 43 according to the first remote operation signal transmitted by the remote operation apparatus 100. The remote operation apparatus 100 includes the remote-operation operation lever 101 (second operation device) that outputs the first remote operation signal for remotely operating the hydraulic actuators 15, 16, 17, and 19*a* and the remote-operation gate lock lever 102 (second gate lock device) that outputs the second remote operation signal for giving an instruction for enabling or disabling of the remote operation by the remote-operation operation lever 101 (second operation device). In a state where the first gate lock valve 45 has been switched to the closed position, the second gate lock valve 53 is allowed to be controlled by the controller 70 when the stairs 25 are in the retracted state, and the second gate lock valve 53 is kept at the closed position irrespective of the second remote operation signal when the stairs 25 are in the extended state.

According to this configuration, when the stairs 25 are in the extended state, the second gate lock valve 53 is kept at the closed position. Thus, the remote operation of the hydraulic actuators 15, 16, 17, and 19*a* by the remote operation apparatus 100 is disabled when the stairs 25 are in the extended state, and the remote operation by the remote operation apparatus 100 is allowed only when the stairs 25 are in the retracted state. Accordingly, it is possible to prevent a situation where the hydraulic excavator 1 (work machine) starts moving by being remotely operated when the stairs 25 are in the extended state and where a worker becomes unable to get out of the hydraulic excavator 1 (work machine). Accordingly, it is possible for the hydraulic excavator 1 (work machine) including the extendable and retractable stairs 25 to suppress the deterioration in the operating rate and productivity which is caused by the remote operation of the hydraulic excavator 1 (work machine).

In addition, the hydraulic excavator 1 (work machine) according to the present embodiment includes the signal circuit switching device 60 that switches, to the connection state or the disconnection state, the signal circuit for outputting a control signal of the controller 70 to the second gate lock valve 53; and the stair retraction sensor 67 (sensor) that senses the retracted state of the stairs 25. The second gate lock valve 53 is configured to be at the closed position when the signal circuit is in the disconnection state. The signal circuit switching device 60 is configured to switch the signal circuit to the connection state when the stair retraction sensor 67 (sensor) senses the retracted state of the stairs 25, and to switch the signal circuit to the disconnection state when the stair retraction sensor 67 (sensor) does not sense the retracted state of the stairs.

According to this configuration, whether to disable or allow the remote operation of the hydraulic actuators 15, 16, 17, and 19*a* by the remote operation apparatus 100 can be switched according to the extended state or the retracted state of the stairs 25 by switching of the signal circuit for controlling the second gate lock valve 53 to the connection state or the disconnection state.

Modification Example of First Embodiment

Figure 5:
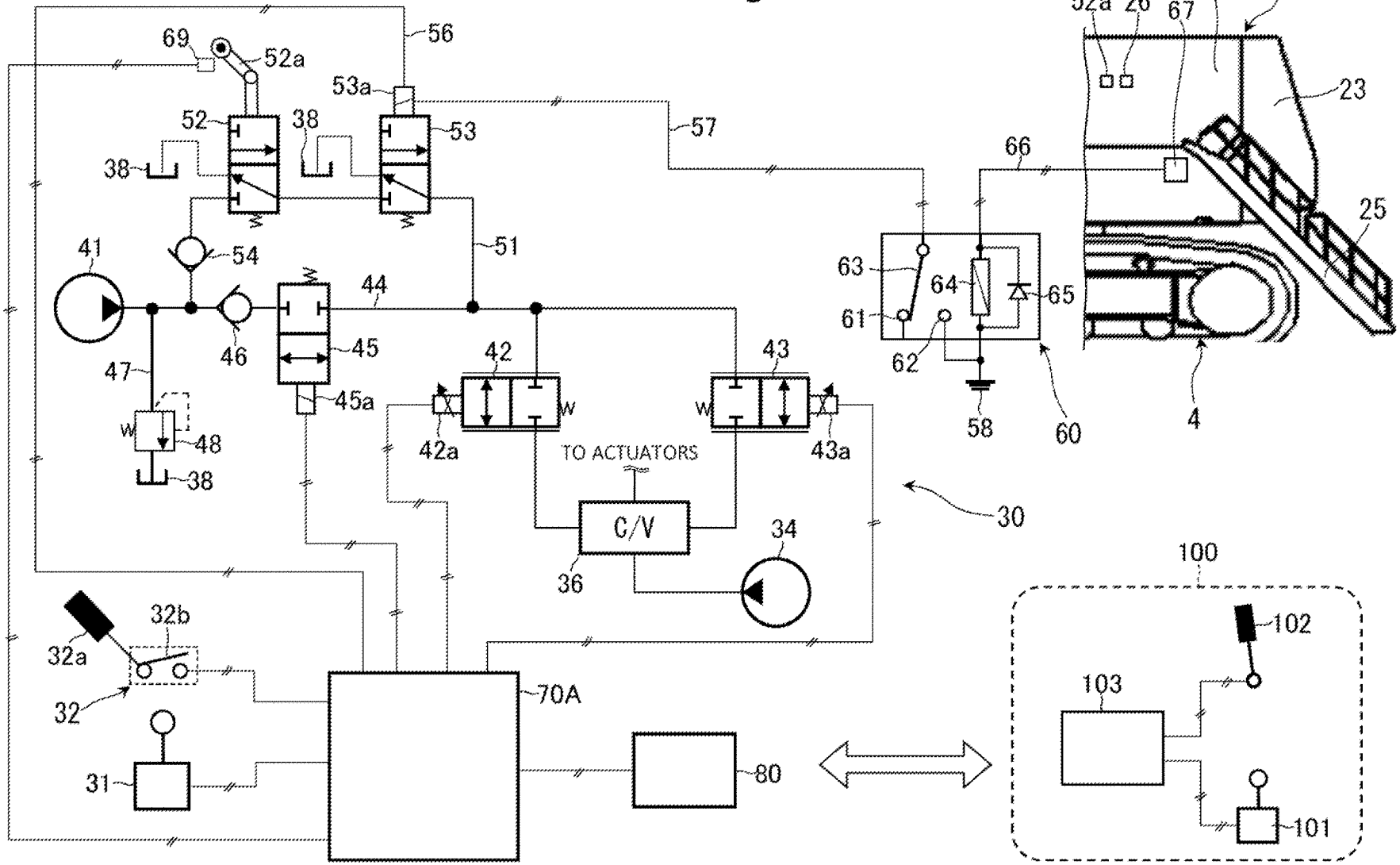
FIG. 5 is a schematic diagram depicting the hydraulic system in a work machine according to a modification example of the first embodiment of the present invention.
Figure 6:
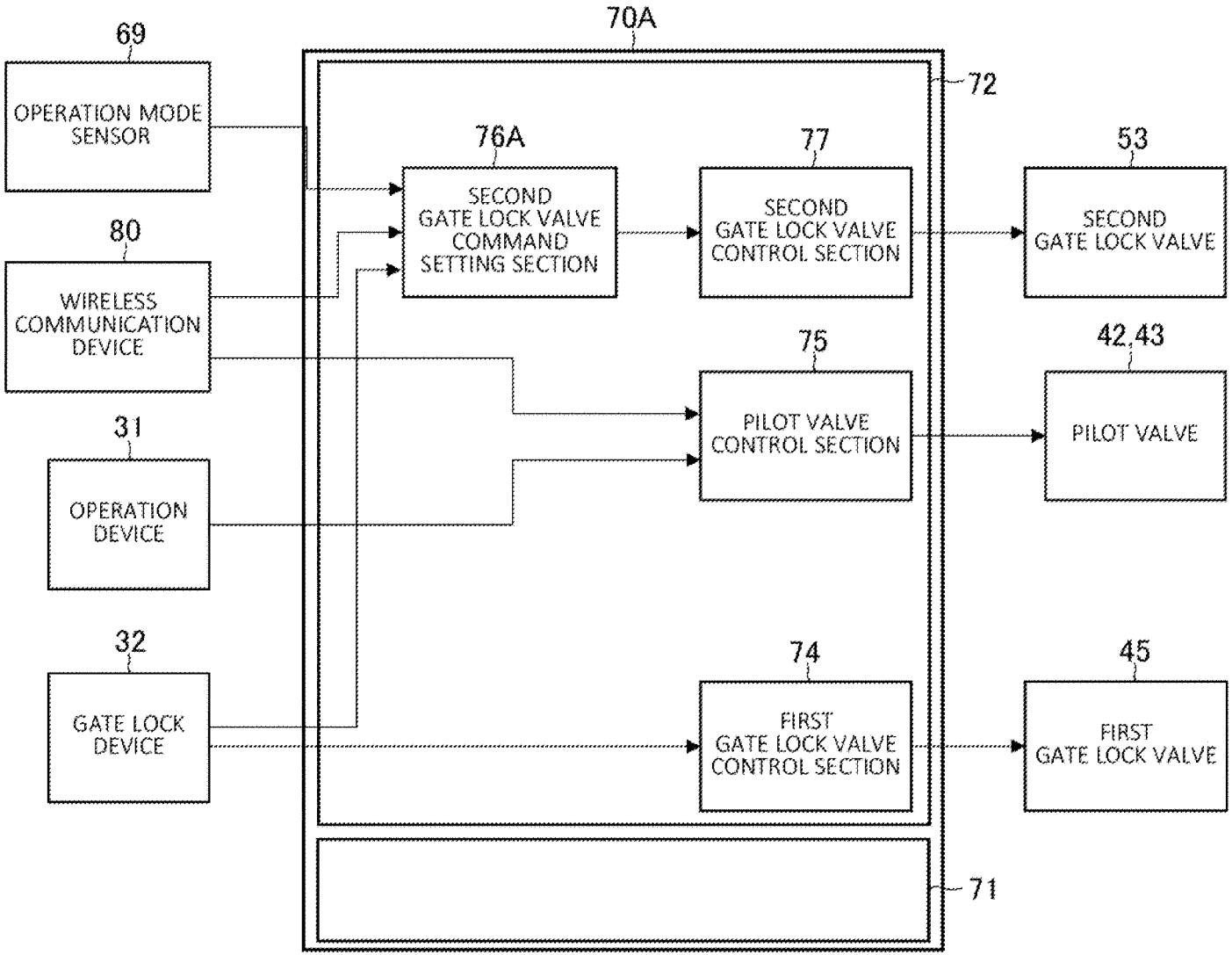
FIG. 6 is a block diagram depicting the functional configuration of a controller included in the work machine according to the modification example of the first embodiment of the present invention depicted in FIG. 5.
Figure 7:
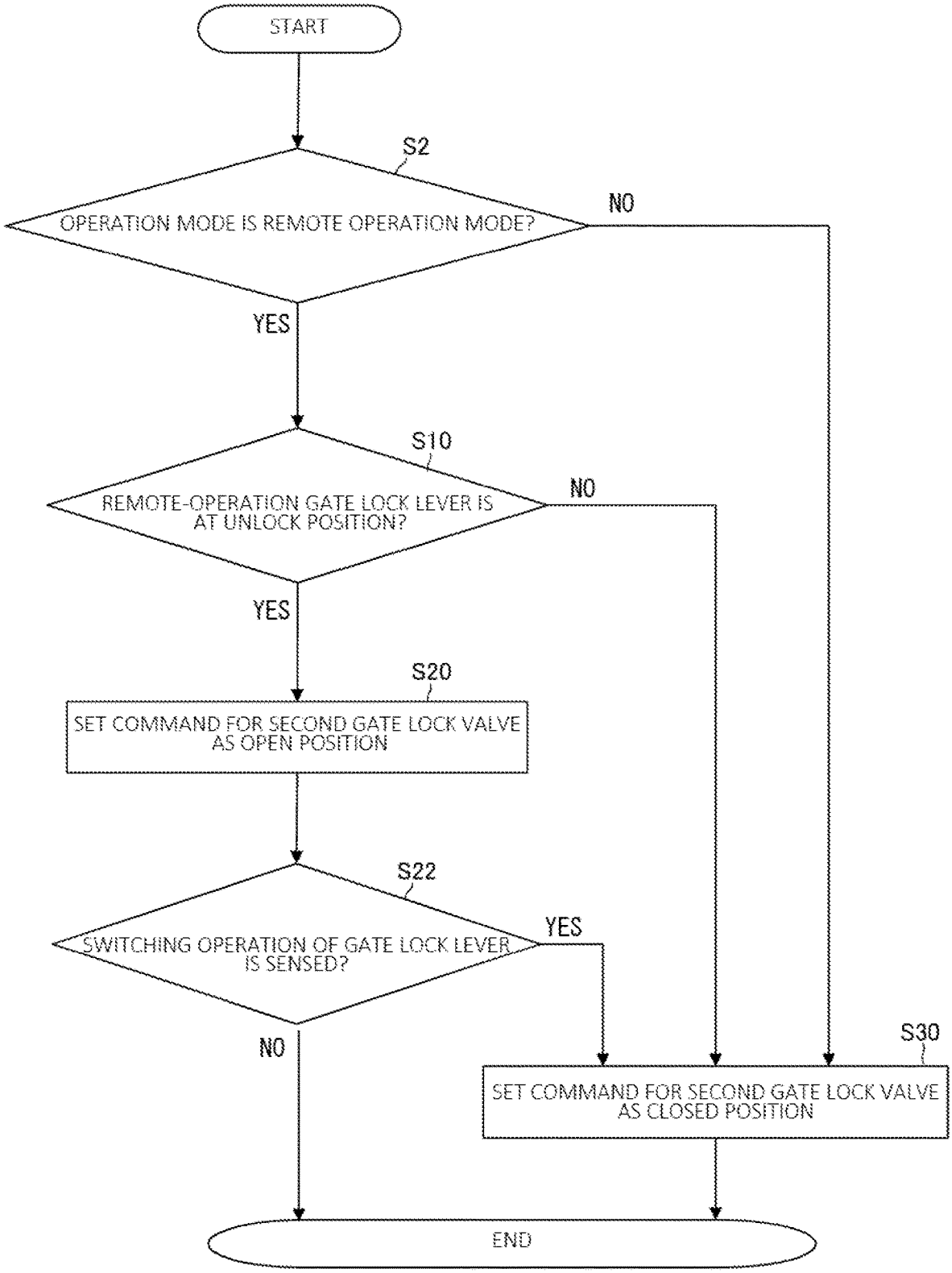
FIG. 7 is a flowchart depicting an example of a processing procedure by a second gate lock valve command setting section in the controller depicted in FIG. 6.

Next, a work machine according to a modification example of the first embodiment of the present invention is explained by using FIG. 5 to FIG. 7. FIG. 5 is a schematic diagram depicting the hydraulic system in the work machine according to the modification example of the first embodiment of the present invention. FIG. 6 is a block diagram depicting the functional configuration of a controller included in the work machine according to the modification example of the first embodiment of the present invention depicted in FIG. 5. FIG. 7 is a flowchart depicting an example of a processing procedure by a second gate lock valve command setting section in the controller depicted in FIG. 6. Note that constituent elements in FIG. 5 to FIG. 7 that are given the same reference characters as those in FIG. 1 to FIG. 4 are similar constituent elements, and accordingly, detailed explanations thereof are omitted.

The work machine according to the modification example of the first embodiment of the present invention depicted in FIG. 5 is different from the work machine according to the first embodiment in that an operation mode sensor 69 that senses the operation position (in-machine operation mode or remote operation mode) of the operation part 52*a* of the operation mode selector valve 52 as the operation mode selector is provided, and that a controller 70A sets a command (open position or closed position) for the second gate lock valve 53 on the basis of the second remote operation signal of the remote-operation gate lock lever 102 of the remote operation apparatus 100, a sensing signal of the operation mode sensor 69, and an operation signal of the gate lock device 32. In the present modification example, when a worker gets in the hydraulic excavator 1 and operates the gate lock lever 32*a* of the gate lock device 32 in a state where the operation part 52*a* as the operation mode selector has been switched to the remote operation mode, an operation made by the worker is given a higher priority than the remote operation by the remote operation apparatus 100.

Specifically, in FIG. 5, the operation mode sensor 69 is disposed at the operation mode selector valve 52 of the hydraulic system 30. The operation mode sensor 69 senses the operation position (in-machine operation mode or remote operation mode) of the operation part 52*a* as the operation mode selector. The operation mode sensor 69 is electrically connected to the controller 70A via a signal line, and outputs, to the controller 70A, a sensing signal indicating whether the operation position of the operation part 52*a* of the operation mode selector valve 52 is the in-machine operation mode or the remote operation mode. Other hardware configuration of the hydraulic system 30 according to the present modification example is similar to that of the hydraulic system 30 of the first embodiment.

The controller 70A has, similarly to the controller 70 of the first embodiment, the first gate lock valve control section 74, the pilot valve control section 75, a second gate lock valve command setting section 76A, and the second gate lock valve control section 77, as depicted in FIG. 6. It should be noted that the second gate lock valve command setting section 76A sets, as a command for the second gate lock valve 53, either the open position or the closed position on the basis of the second remote operation signal (lock signal or unlock signal) of the remote-operation gate lock lever 102 output from the wireless communication device 80, the sensing signal (in-machine operation mode or remote operation mode) output from the operation mode sensor 69, and the operation signal output from the gate lock device 32.

The second gate lock valve command setting section 76A sets the command according to the flowchart depicted in FIG. 7, for example. First, the second gate lock valve command setting section 76A determines whether or not the operation position (operation mode) of the operation part 52*a* as the operation mode selector is the remote operation mode, on the basis of the sensing signal output from the operation mode sensor 69 (Step S2 in FIG. 7). When it is determined that the operation position (operation mode) of the operation part 52*a* is the remote operation mode (YES), the procedure proceeds to Step S10. On the other hand, when it is determined that the operation position (operation mode)

of the operation part 52*a* is the in-machine operation mode (NO), the procedure proceeds to Step S30.

When the result of the determination in Step S2 is YES, similarly to the second gate lock valve command setting section 76 of the first embodiment, it is determined whether or not the remote-operation gate lock lever 102 is at the unlock position, on the basis of the operation signal of the remote-operation gate lock lever 102 output from the wireless communication device 80 (Step S10 in FIG. 7). When it is determined that the remote-operation gate lock lever 102 is at the unlock position (YES), the procedure proceeds to Step S20. On the other hand, when it is determined that the remote-operation gate lock lever 102 is at the lock position (NO), the procedure proceeds to Step S30.

When the result of the determination in Step S10 is YES, a command for the second gate lock valve 53 is set as the open position (Step S20 in FIG. 7). When the command for the second gate lock valve 53 is set as the open position in Step S20, it is determined whether or not a switching operation (a change in the operation signal) of the gate lock device 32 is sensed (Step S22 in FIG. 7). When it is determined that the switching operation of the gate lock device 32 is sensed (YES), the procedure proceeds to Step S30. On the other hand, when it is determined that the switching operation of the gate lock device 32 is not sensed (NO), the procedure ends.

When the result of the determination in Step S2 or S10 is NO or when the result of the determination in Step S22 is YES, a command for the second gate lock valve 53 is set as the closed position (Step S30 in FIG. 7).

Next, the operation and advantages of the work machine according to the modification example of the first embodiment of the present invention are explained by using FIG. 5 to FIG. 7.

In the first embodiment, when the operation part 52*a* of the operation mode selector valve 52 is at the position of the remote operation mode and the remote-operation gate lock lever 102 of the remote operation apparatus 100 is operated at the unlock position, the hydraulic fluid from the pilot pump 41 is undesirably supplied to the pilot valves 42 and 43 via the operation mode selector valve 52 at the open position and the second gate lock valve 53 at the open position on the second pilot line 51 even if the gate lock lever 32*a* is operated at the lock position by a worker who is in the hydraulic excavator 1. Because of this, even when the worker in the hydraulic excavator 1 intends to stop an operation of the hydraulic excavator 1 by operating the gate lock lever 32*a* to switch the gate lock lever 32*a* to the lock position, the hydraulic excavator 1 is actuated undesirably if the remote-operation operation lever 101 is operated. In this case, the worker in the hydraulic excavator 1 cannot get out of the hydraulic excavator 1, and the operation rate and productivity of the hydraulic excavator 1 deteriorate undesirably.

In contrast, in the present modification example, when the gate lock lever 32*a* is switch-operated by a worker who is in the hydraulic excavator 1 in a state where the operation part 52*a* of the operation mode selector valve 52 depicted in FIG. 5 is at the position of the remote operation mode, the first gate lock valve control section 74 of the controller 70A depicted in FIG. 6 controls the first gate lock valve 45 such that the first gate lock valve 45 is caused to be at the closed position or the open position according to the operation signal (lock position or unlock position) output from the gate lock device 32. In addition, the second gate lock valve command setting section 76A of the controller 70A ignores the second remote operation signal of the remote-operation gate lock lever 102 when the switching operation (a change in the operation signal) of the gate lock device 32 is sensed, and sets a command for the second gate lock valve 53 as the closed position according to Step S22 in the flowchart depicted in FIG. 7. The second gate lock valve control section 77 controls the second gate lock valve 53 such that the second gate lock valve 53 is caused to be at the closed position according to the command for the second gate lock valve 53 set as the closed position by the second gate lock valve command setting section 76A.

In this manner, in the present modification example, when operations of the operation device 31 and the gate lock device 32 by a worker who is in the hydraulic excavator 1 and the remote operation by the remote operation apparatus 100 are performed simultaneously in a state where the operation part 52*a* of the operation mode selector valve 52 is at the position of the remote operation mode, the second gate lock valve 53 is switched to the closed position in response to the switching operation of the gate lock device 32. Thus, the operation made by the worker in the hydraulic excavator 1 can be given a high priority. That is, the authority to operate the hydraulic excavator 1 can be transferred to the worker in the hydraulic excavator 1. Accordingly, the worker in the hydraulic excavator 1 can operate or stop the hydraulic excavator 1 as intended by the worker. Therefore, the worker in the hydraulic excavator 1 can stop the hydraulic excavator 1 and get out of the hydraulic excavator 1 by using the stairs 25 as necessary even if the operation mode is the remote operation mode.

With the work machine according to the modification example of the first embodiment of the present invention mentioned above, similarly to the above-mentioned first embodiment, when the stairs 25 are in the extended state, the second gate lock valve 53 is kept at the closed position. Thus, the remote operation of the hydraulic actuators 15, 16, 17, and 19*a* by the remote operation apparatus 100 is disabled, and it is possible to prevent a situation where the hydraulic excavator 1 starts moving by being remotely operated when the stairs 25 are in the extended state and where the worker becomes unable to get out of the hydraulic excavator 1. Accordingly, it is possible for the hydraulic excavator 1 including the extendable and retractable stairs 25 to suppress the deterioration in the operating rate and productivity which is caused by the remote operation of the hydraulic excavator 1.

In addition, the hydraulic excavator (work machine) according to the present modification example further includes the operation mode sensor 69 that senses the operation position of the operation part 52*a* (operation mode selector). The controller 70A ignores the second remote operation signal and switches the second gate lock valve 53 to the closed position when the switching operation of the gate lock device 32 (first gate lock device) is sensed, even if the controller determines based on a sensing result of the operation mode sensor 69 that the operation position of the operation part 52*a* (operation mode selector) is the operation position for the remote operation mode.

According to this configuration, even with the operation part 52*a* (operation mode selector) being at the position of the remote operation mode, when the switching operation of the gate lock device 32 (first gate lock device) is performed by a worker in the hydraulic excavator 1, the second gate lock valve 53 is switched to the closed position to thereby disable the remote operation of the hydraulic actuators 15, 16, 17, and 19*a* by the remote operation apparatus 100. Accordingly, when the remote operation by the remote operation apparatus 100 and the in-machine operation by a worker who is in the operation room 21 are executed simultaneously at a time of the remote operation mode, the in-machine operation can be prioritized over the remote operation.

Note that, in the present modification example, a case has been described where the controller 70A gives a higher priority to the operation by a worker than the remote operation when the gate lock lever 32*a* of the hydraulic excavator 1 is operated by the worker in a state where the operation mode is the remote operation mode. However, the mode of the operation of the hydraulic excavator 1 according to the present modification example is merely an example.

For example, the controller 70A may not only keep the second gate lock valve 53 at the closed position but also keep the first gate lock valve 45 at the closed position, irrespective of whether or not the gate lock lever 32*a* is operated, when the stairs 25 are in the extended state and the operation mode is the remote operation mode. Accordingly, the operation of the hydraulic excavator 1 can surely be prevented while the stairs 25 are still in the extended state.

In addition, for example, in the case where the remote operation is given a higher priority than the operation by a worker, the controller 70A may keep the first gate lock valve 45 at the closed position irrespective of whether or not the gate lock lever 32*a* is operated when the operation mode is the remote operation mode.

Second Embodiment

Figure 8:
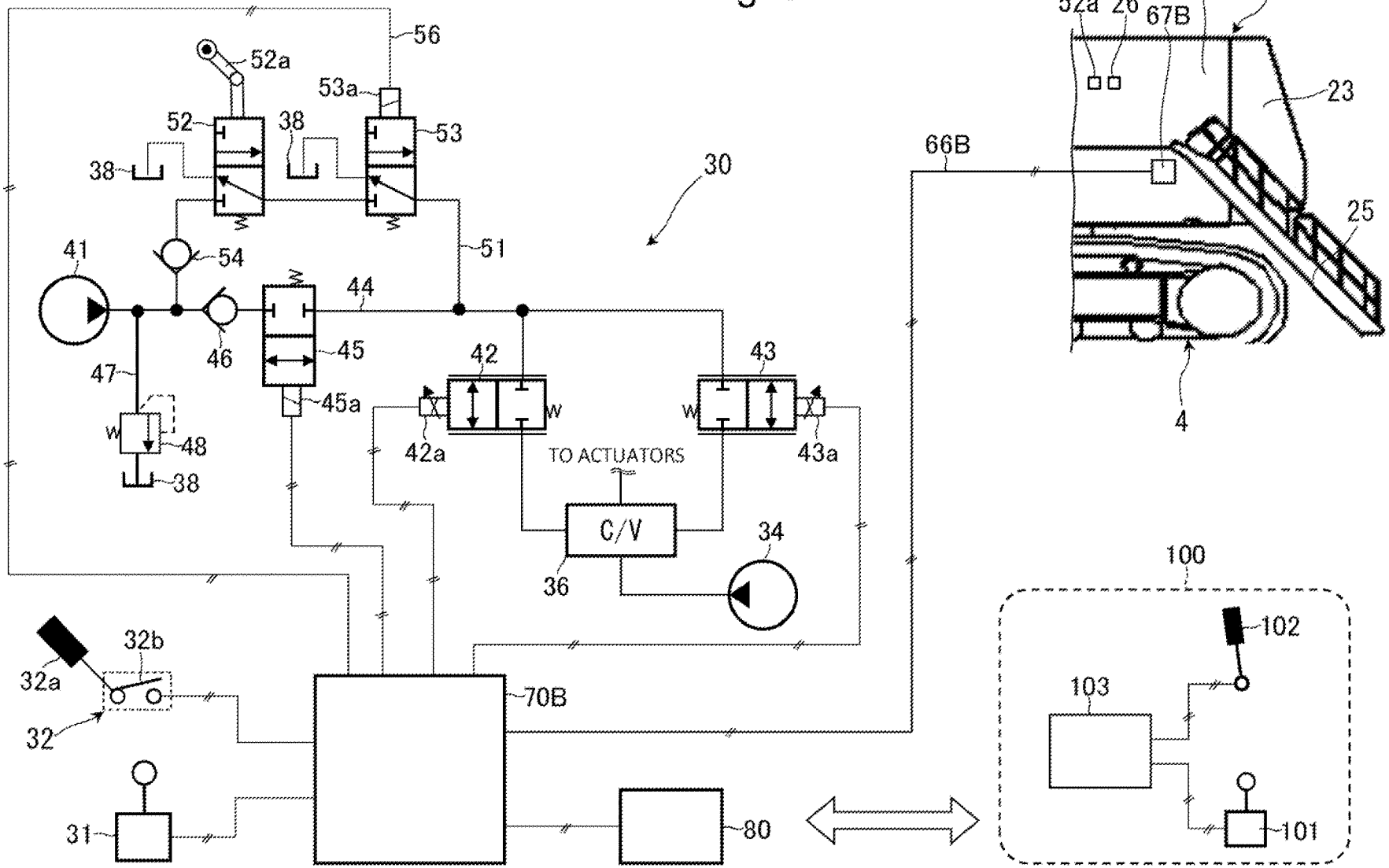
FIG. 8 is a schematic diagram depicting the hydraulic system in a work machine according to a second embodiment of the present invention.
Figure 9:
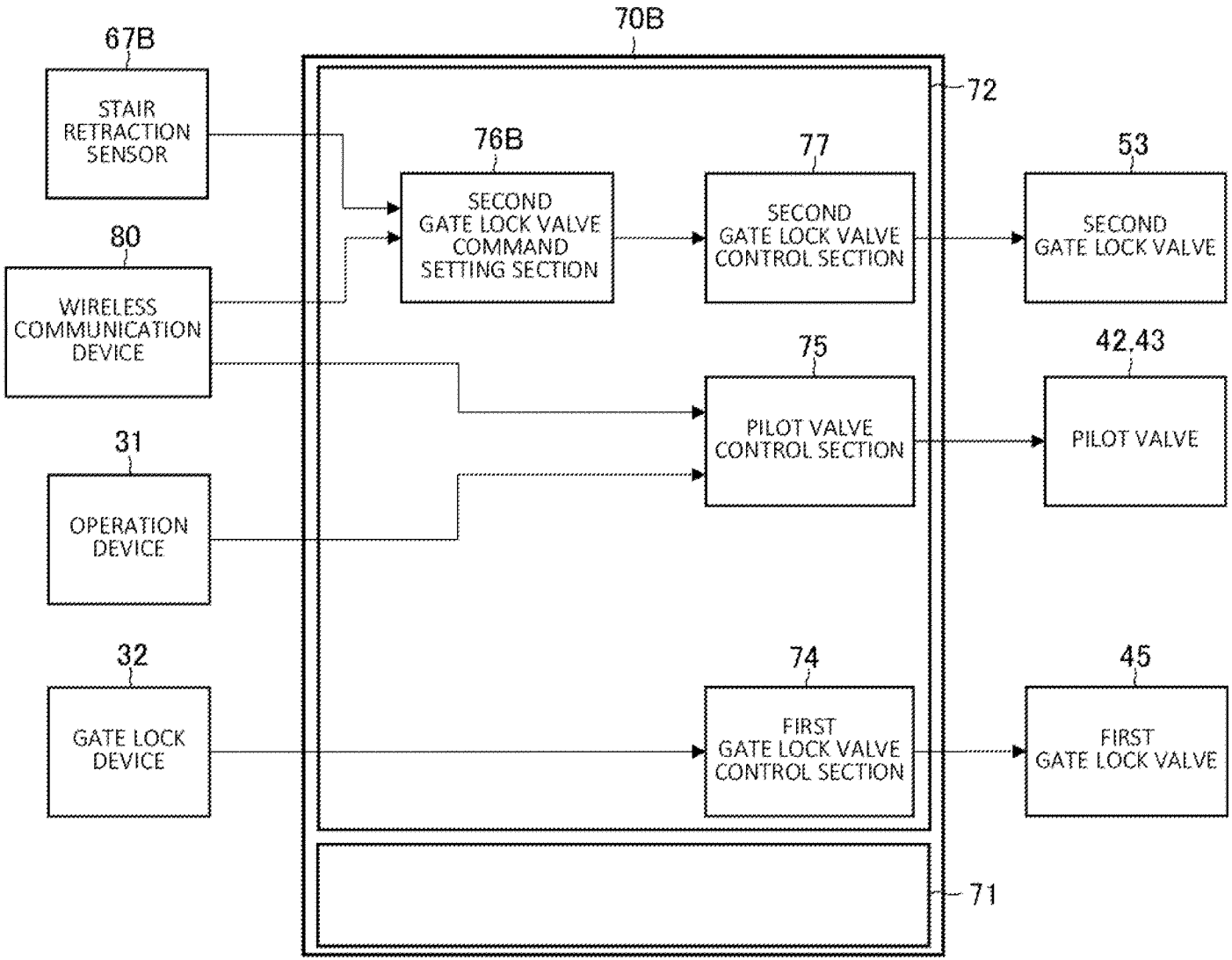
FIG. 9 is a block diagram depicting the functional configuration of a controller included in the work machine according to the second embodiment of the present invention depicted in FIG. 8.
Figure 10:
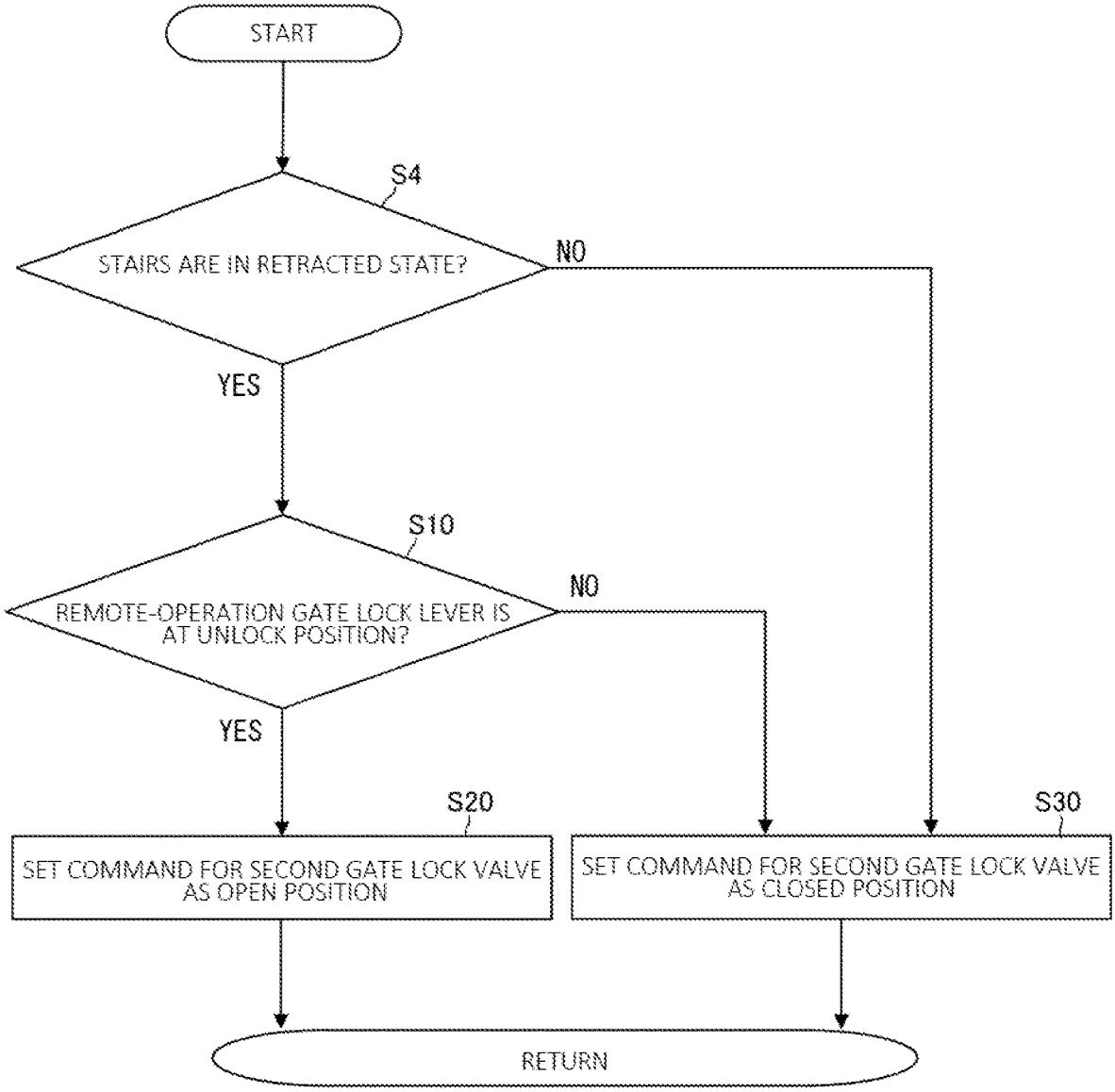
FIG. 10 is a flowchart depicting an example of a processing procedure by a second gate lock valve command setting section in the controller depicted in FIG. 9.

Next, a work machine according to a second embodiment of the present invention is explained by using FIG. 8 to FIG. 10. FIG. 8 is a schematic diagram depicting the hydraulic system in the work machine according to the second embodiment of the present invention. FIG. 9 is a block diagram depicting the functional configuration of a controller included in the work machine according to the second embodiment of the present invention depicted in FIG. 8. FIG. 10 is a flowchart depicting an example of a processing procedure by a second gate lock valve command setting section in the controller depicted in FIG. 9. Note that constituent elements in FIG. 8 to FIG. 10 that are given the same reference characters as those in FIG. 1 to FIG. 7 are similar constituent elements, and accordingly, detailed explanations thereof are omitted.

The work machine according to the second embodiment of the present invention is different from the work machine according to the first embodiment in that the signal circuit switching device 60 (relay) which switches the signal circuit for controlling the second gate lock valve 53 to the connection state or the disconnection state is deleted and that a controller 70B controls the opening and closing of the second gate lock valve 53 according to a sensing result of a stair retraction sensor 67B.

Specifically, as depicted in FIG. 8, the hydraulic system 30 is not provided with the relay 60 (see FIG. 2) which is the signal circuit switching device of the first embodiment, and the excitation coil 53*a* of the second gate lock valve 53 is electrically connected to the controller 70B via the signal line 56. That is, the signal circuit for outputting a control signal of the controller 70B to the excitation coil 53*a* of the second gate lock valve 53 is always in the connection state. In addition, the stair retraction sensor 67B is electrically connected to the controller 70B via a signal line 66B, and outputs a sensing signal (ON signal or OFF signal) indicating the retracted state or the extended state of the stairs 25 to the controller 70B. Other hardware configuration the hydraulic system 30 of the second embodiment is similar to the hardware configuration of the hydraulic system 30 of the first embodiment.

The controller 70B has, similarly to the controller 70 of the first embodiment, the first gate lock valve control section 74, the pilot valve control section 75, a second gate lock valve command setting section 76B, and the second gate lock valve control section 77, as depicted in FIG. 9. It should be noted that the second gate lock valve command setting section 76B sets, as a command for the second gate lock valve 53, either the open position or the closed position based on the second remote operation signal (lock signal or unlock signal) of the remote-operation gate lock lever 102 output from the wireless communication device 80 and the sensing signal (ON signal or OFF signal) output from the stair retraction sensor 67B.

The second gate lock valve command setting section 76B sets the command according to the flowchart depicted in FIG. 10, for example. First, the second gate lock valve command setting section 76B determines whether or not the stairs 25 are in the retracted state, on the basis of the sensing signal output from the stair retraction sensor 67B (Step S4 in FIG. 10). When it is determined that the stairs 25 are in the retracted state (YES), the procedure proceeds to Step S10. On the other hand, when it is determined that the stairs 25 are in the extended state (NO), the procedure proceeds to Step S30.

When the result of the determination in Step S4 is YES, similarly to the second gate lock valve command setting section 76 of the first embodiment, it is determined whether or not the remote-operation gate lock lever 102 is at the unlock position, on the basis of the second remote operation signal of the remote-operation gate lock lever 102 output from the wireless communication device 80 (Step S10 in FIG. 10). When it is determined that the remote-operation gate lock lever 102 is at the unlock position (YES), the procedure proceeds to Step S20. On the other hand, when it is determined that the remote-operation gate lock lever 102 is at the lock position (NO), the procedure proceeds to Step S30.

When the result of the determination in Step S10 is YES, a command for the second gate lock valve 53 is set as the open position (Step S20 in FIG. 10). On the other hand, when the result of the determination in Step S4 or S10 is NO, a command for the second gate lock valve 53 is set as the closed position (Step S30 in FIG. 10).

Next, the operation and advantages of the work machine according to the second embodiment of the present invention are explained by using FIG. 8 to FIG. 10.

When the stairs 25 depicted in FIG. 8 are retracted, the stair retraction sensor 67B senses the retracted state of the stairs 25, and outputs a sensing signal (ON signal) corresponding to the retracted state to the controller 70B. The controller 70B controls the opening and closing of the second gate lock valve 53 according to the second remote operation signal from the remote operation apparatus 100 when it is determined that the stairs 25 are in the retracted state on the basis of the sensing signal from the stair retraction sensor 67B. That is, when the stairs 25 are in the retracted state, the remote operation of the hydraulic actuators 15, 16, 17, and 19*a* by the remote-operation operation lever 101 is allowed.

On the other hand, when the stairs 25 are in the extended state, the stair retraction sensor 67B senses the extended state of the stairs 25, and outputs a sensing signal (OFF signal) corresponding to the extended state to the controller 70B. The controller 70B ignores the second remote operation signal from the remote operation apparatus 100 and switches the second gate lock valve 53 to the closed position when it is determined that the stairs 25 are in the extended state on the basis of the sensing signal from the stair retraction sensor 67B (Steps S4 and S30 in FIG. 10). Since the second gate lock valve 53 is at the closed position, the hydraulic fluid from the pilot pump 41 cannot be supplied to the pilot valves 42 and 43 via the second pilot line 51. Accordingly, when the stairs 25 are in the extended state, the remote operation of the hydraulic actuators 15, 16, 17, and 19*a* by the remote-operation operation lever 101 is disabled.

With the work machine according to the second embodiment of the present invention mentioned above, similarly to the above-mentioned first embodiment, when the stairs 25 are in the extended state, the second gate lock valve 53 is kept at the closed position. Thus, the remote operation of the hydraulic actuators 15, 16, 17, and 19*a* by the remote operation apparatus 100 is disabled, and it is possible to prevent a situation where the hydraulic excavator 1 starts moving by being remotely operated when the stairs 25 are in the extended state and where the worker becomes unable to get out of the hydraulic excavator 1. Accordingly, it is possible for the hydraulic excavator 1 including the extendable and retractable stairs 25 to suppress the deterioration in the operating rate and productivity which is caused by the remote operation of the hydraulic excavator 1.

In addition, the hydraulic excavator (work machine) according to the present embodiment includes the stair retraction sensor 67B (sensor) that senses the retracted state of the stairs 25. The controller 70B determines whether the stairs 25 is in the retracted state or the extended state, based on a sensing result of the stair retraction sensor 67B (sensor). The controller 70B controls the second gate lock valve 53 such that the second gate lock valve 35 is caused to be at the closed position or the open position according to the second remote operation signal when determining that the stairs 25 are in the retracted state. On the other hand, the controller 70B ignores the second remote operation signal and controls the second gate lock valve 53 such that the second gate lock valve is caused to be at the closed position when determining that the stairs 25 are in the extended state.

According to this configuration, whether to disable or allow the remote operation of the hydraulic actuators 15, 16, 17, and 19*a* by the remote operation apparatus 100 can be switched according to the extended state or the retracted state of the stairs 25 by execution of functionalities by software of the controller 70B. Accordingly, switching of disabling and allowing of the remote operation of the hydraulic actuators 15, 16, 17, and 19*a* by the remote operation apparatus 100 according to the extended state or the retracted state of the stairs 25 can be performed with simpler hardware configuration as compared with the first embodiment where the switching is performed by an electrical circuit including the relay 60.

Other Embodiments

Note that, in the embodiments mentioned above, a case has been described where the present invention is applied to the large-sized hydraulic excavator 1 including the extendable and retractable stairs 25. However, the present invention can widely be applied to various work machines such as large-sized bulldozers including extendable and retractable stairs, for example.

In addition, the present invention is not limited to the present embodiments mentioned above, and includes various modification examples. The above-mentioned embodiments are explained in detail for explaining the present invention in an easy-to-understand manner, and the present invention is not necessarily limited to one including all constituent elements explained. It is possible to replace some of the constituent elements of an embodiment with constituent elements of another embodiment, and it is also possible to add constituent elements of an embodiment to the constituent elements of another embodiment. In addition, some of the constituent elements of each embodiment can have other constituent elements additionally, be deleted, or be replaced.

For example, in the second embodiment, the work machine can further include the operation mode sensor 69 according to the modification example of the first embodiment. In this case, similarly to the modification example, the second gate lock valve command setting section of the controller sets a command for the second gate lock valve 53 as the closed position when the switching operation of the gate lock device 32 is sensed, even if the operation mode sensor 69 senses the remote operation mode.

In addition, in the second embodiment, an example has been described where the switch is used as the sensor that senses the retracted state of the stairs. However, the switch may not be used as long as there is a sensor that can sense the retracted state of the stairs.

For example, a camera that can capture images of the stairs can be used as the sensor. In this case, the camera is electrically connected with the controller and outputs, to the controller, captured-image data as a result of sensing by the sensor. The controller determines whether or not the stairs are in the retracted state (or in the extended state), on the basis of the captured-image data of the camera instead of an ON signal or an OFF signal of the switch.

In addition, the stair operation switch 26 can also be used as a sensor that can sense the retracted state of the stairs. In this case, the stair operation switch 26 is electrically connected with the controller and outputs, to the controller, an operation signal of the stair operation switch 26 (an operation signal for retracting the stairs) as a result of sensing by the sensor. The controller determines whether or not the stairs are in the retracted state (or in the extended state), on the basis of the operation signal of the stair operation switch 26. For example, the controller determines that the stairs 25 are in the retracted state, after a predetermined length of time has elapsed since input of the operation signal indicating a retraction operation of the stair operation switch 26.

In addition, the controller may determine not only whether the stairs 25 are in the retracted state or in the extended state, but also whether the stairs are in a transitional (moving) state between the retracted state and the extended state, that is, a state where the stairs 25 have started being extended from the retracted state but are still not in the extended state or a state where the stairs 25 have started being retracted from the extended state but are still not in the retracted state, by using the switch or the stair operation switch 26 as the sensor. Then, for example, the controller puts the second gate lock valve 53 at the closed position when the stairs 25 are in the transitional state, and thus, it is possible to allow a worker to get out of the hydraulic excavator 1 more surely.

DESCRIPTION OF REFERENCE CHARACTERS

1: Hydraulic excavator (work machine)
21: Operation room
15: Boom cylinder (hydraulic actuator)
16: Arm cylinder (hydraulic actuator)

17: Bucket cylinder (hydraulic actuator)
19*a*: Travel hydraulic motor (hydraulic actuator)
25: Stairs
31: Operation device (first operation device)
32: Gate lock device (first gate lock device)
36: Control valve
41: Pilot pump (pilot hydraulic fluid source)
42, 43: Pilot valve
44: First pilot line
45: First gate lock valve
51: Second pilot line
52: Operation mode selector valve (selector valve)
52*a*: Operation part (operation mode selector)
53: Second gate lock valve
60: Signal circuit switching device
67, 67B: Stair retraction sensor
69: Operation mode sensor
70, 70A, 70B: Controller
100: Remote operation apparatus
101: Remote-operation operation lever (second operation device)
102: Remote-operation gate lock lever (second gate lock device)

The invention claimed is:

1. A work machine comprising an operation room into which a worker gets, stairs that are able to be switched to an extended state where the stairs allow the worker to get into and out of the operation room or a retracted state where the stairs are retracted so as not to interrupt work, a hydraulic actuator that is driven by supply of a hydraulic fluid, a hydraulic-pilot type control valve that controls a flow of the hydraulic fluid supplied to the hydraulic actuator, a pilot valve that generates a pilot pressure for driving the control valve, by using a pressure from a pilot hydraulic fluid source as a source pressure, a first pilot line that introduces the hydraulic fluid from the pilot hydraulic fluid source to the pilot valve, a first gate lock valve disposed on the first pilot line, the first gate lock valve being configured to be switched to either an open position for allowing supply of the hydraulic fluid from the pilot hydraulic fluid source to the pilot valve or a closed position for interrupting the supply of the hydraulic fluid from the pilot hydraulic fluid source to the pilot valve, a first operation device that is arranged in the operation room and that is used to operate the hydraulic actuator, and a first gate lock device that is arranged in the operation room and that is used to operate the first gate lock valve, the work machine being capable of being remotely operated by a remote operation apparatus at a location away from the operation room, the work machine comprising:

a second pilot line that introduces the hydraulic fluid from the pilot hydraulic fluid source to the pilot valve bypassing the first gate lock valve;

a second gate lock valve disposed on the second pilot line, the second gate lock valve being configured to be switched to either an open position for allowing the supply of the hydraulic fluid from the pilot hydraulic fluid source to the pilot valve or a closed position for interrupting the supply of the hydraulic fluid from the pilot hydraulic fluid source to the pilot valve;

an operation mode selector that is switched manually by the worker to either an operation position for a remote operation mode or an operation position for an in-machine operation mode, the remote operation mode representing a mode for a remote operation by the remote operation apparatus, the in-machine operation mode representing a mode for an operation by the worker who is in the operation room;

a selector valve disposed on the second pilot line, the selector valve being configured to be switched, by the switching operation of the operation mode selector, to either an open position for allowing the supply of the hydraulic fluid from the pilot hydraulic fluid source to the pilot valve or a closed position for interrupting the supply of the hydraulic fluid from the pilot hydraulic fluid source to the pilot valve; and a controller that controls an opening of the pilot valve according to a first remote operation signal transmitted by the remote operation apparatus and that controls the second gate lock valve such that the second gate lock valve is caused to be at either the open position or the closed position on a basis of a second remote operation signal transmitted by the remote operation apparatus, the remote operation apparatus including a second operation device that outputs the first remote operation signal for remotely operating the hydraulic actuator and a second gate lock device that outputs the second remote operation signal for giving an instruction for enabling or disabling of the remote operation by the second operation device, wherein in a state where the first gate lock valve has been switched to the closed position, the second gate lock valve is allowed to be controlled by the controller when the stairs are in the retracted state and is kept at the closed position irrespective of the second remote operation signal when the stairs are in the extended state.

2. The work machine according to claim 1, further comprising:

a signal circuit switching device that switches a signal circuit to a connection state or a disconnection state, the signal circuit being for outputting a control signal of the controller to the second gate lock valve; and a sensor that senses the retracted state of the stairs, wherein the second gate lock valve is configured to be at the closed position when the signal circuit is in the disconnection state, and the signal circuit switching device is configured to switch the signal circuit to the connection state when the sensor senses the retracted state of the stairs, and to switch the signal circuit to the disconnection state when the sensor does not sense the retracted state of the stairs.

3. The work machine according to claim 1, further comprising:

a sensor that senses the retracted state of the stairs, wherein the controller is configured to determine whether the stairs are in the retracted state or in the extended state, on a basis of a sensing result of the sensor, control, when determining that the stairs are in the retracted state, the second gate lock valve such that the second gate lock valve is caused to be at the closed position or the open position according to the second remote operation signal, and control, when determining that the stairs are in the extended state, the second gate lock valve such that the second gate lock valve is caused to be at the closed position while ignoring the second remote operation signal.

4. The work machine according to claim 1, further comprising:

an operation mode sensor that senses the operation position of the operation mode selector, wherein the controller switches, when a switching operation of the first gate lock device is sensed, the second gate lock valve to the closed position while ignoring the second remote operation signal, even if determining on a basis of a sensing result of the operation mode sensor that the operation position of the operation mode selector is the operation position for the remote operation mode.

* * * * *